US009440464B2

(12) United States Patent
Kako

(10) Patent No.: US 9,440,464 B2
(45) Date of Patent: Sep. 13, 2016

(54) PRINT LABEL PRODUCING APPARATUS

(71) Applicant: Brother Kogyo Kabushiki Kaisha, Nagoya-shi, Aichi-ken (JP)

(72) Inventor: Keigo Kako, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/842,399

(22) Filed: Sep. 1, 2015

(65) Prior Publication Data

US 2016/0059590 A1 Mar. 3, 2016

(30) Foreign Application Priority Data

Sep. 2, 2014 (JP) ..... 2014-178569

(51) Int. Cl.
*B41J 11/66* (2006.01)
*B41J 3/46* (2006.01)

(52) U.S. Cl.
CPC ..... *B41J 11/663* (2013.01); *B41J 3/46* (2013.01); *B41J 11/666* (2013.01)

(58) Field of Classification Search
CPC ..... B41J 11/663; B41J 15/00; B41J 3/46
See application file for complete search history.

(56) References Cited

U.S. PATENT DOCUMENTS

2015/0086742 A1* 3/2015 Ehara ..... B41J 11/663 428/41.8

FOREIGN PATENT DOCUMENTS

| | | | |
|---|---|---|---|
| JP | 2000-006472 A | | 1/2000 |
| JP | 2003-285486 A | | 10/2003 |
| JP | 2003285486 A | * | 10/2003 |
| JP | 2011-062985 A | | 3/2011 |

* cited by examiner

*Primary Examiner* — Sarah Al Hashimi
(74) *Attorney, Agent, or Firm* — Banner & Witcoff, Ltd.

(57) ABSTRACT

The disclosure discloses a print label producing apparatus including a controller. The controller is configured to execute a print contents acquisition process, a cut pattern acquisition process, a coordination control process, and a display control process. In a cut pattern acquisition process, specification of a cut pattern related to formation of a full-cut position and a half-cut position in producing a print label is acquired. In a coordination control process, print contents acquired are formed on a print-receiving tape, and the half-cut position or the full-cut position are formed in accordance with the cut pattern acquired. In a display control process, a display device is controlled to display an appearance image of a print label together with an identification display of all cut positions of the full-cut position and the half-cut position.

10 Claims, 15 Drawing Sheets

PRINT LABEL PRODUCING APPARATUS

CROSS-REFERENCE TO RELATED APPLICATION

The present application claims priority from Japanese Patent Application No. 2014-178569, which was filed on Sep. 2, 2014, the disclosure of which is incorporated herein by reference in its entirety.

BACKGROUND

1. Field

The present disclosure relates to a print label producing apparatus for producing a print label using a print-receiving tape.

2. Description of the Related Art

The print label producing apparatus for producing the print label by forming a desired print on the print-receiving tape has been well known. With the prior art, a print is formed by a printing device (thermal head) on a print-receiving tape (surface layer tape) fed by a feeder (platen roller), which is further bonded to a double-coated adhesive tape so that the tape with print (laminated tape) is produced. The tape with print is subjected to the half-cut process by a half-cut unit (half-cutter unit), and the full-cut process by a full-cut unit (full-cutter unit) to produce the print label.

Generally, a user is allowed to manually specify the cut pattern of the half-cut unit or the full-cut unit in producing the print label as described above. The above-described print label is produced by performing the half-cut process and the full-cut process in accordance with the cut pattern specified by the user.

The print label producing apparatus of some type includes a function for providing a margin at a terminal end of the tape with print having the half-cut position at the boundary so as to avoid deteriorated convenience caused by the excessively short print label when, for example, the amount of print contents is small (for example, small number of characters of text). Especially, such a function is often provided for the prior art print label producing apparatus of type as described above, which is structured to have the relatively large distance between the full-cutter unit and the discharging exit of the housing (from the safety aspect or the like). When such a function is executed, even in the case where the user is allowed to set the cut pattern only to the full-cut position (formation of the half-cut position is not included), the print label actually produced has the half-cut position at the starting end portion of the margin, resulting in the print label longer than intended by the user. Upon use of the print label producing apparatus, it is difficult for the user to visually recognize with what pattern and length the intended print label is cut and produced. Therefore, there is still room for improvement in convenience.

SUMMARY

It is an object of the present disclosure to provide a print label producing apparatus with improved convenience by allowing the user to intuitively and simply recognize visually with what pattern and length the print label is cut and produced.

In order to achieve the above-described object, according to the aspect of the present application, there is provided a print label producing apparatus comprising a feeder configured to feed a print-receiving tape, a printing head configured to form a print on the print-receiving tape fed by the feeder to produce a tape with print, a half-cutter configured to form a half-cut position by partially cutting the tape with print in a thickness direction, a cutter configured to form a full-cut position by fully cutting the tape with print in the thickness direction, a display device configured to provide a desired display, and a controller, the print label producing apparatus being configured to produce a print label by the tape with print that has been fully cut by the cutter, the controller being configured to execute a print contents acquisition process for acquiring print contents to be formed on the print label, a cut pattern acquisition process for acquiring specification of a cut pattern related to formation of the full-cut position and the half-cut position in producing the print label, a coordination control process for forming the print contents acquired in the print contents acquisition process on the print-receiving tape, and forming the half-cut position or the full-cut position in accordance with the cut pattern acquired in the cut pattern acquisition process so as to produce the print label by controlling the feeder, the printing head, the half-cutter and the cutter in producing the label, and a display control process for controlling the display device triggered by an appropriate operation before the print label is produced by the control in the coordination control process to display an appearance image of the print label to be produced together with an identification display of all cut positions of the full-cut position and the half-cut position formed in producing the print label.

According to the present disclosure, the printing head forms a print on the print-receiving tape fed by the feeder so as to produce the tape with print. The tape with print is subjected to the half-cut process by the half-cut unit and the full-cut process by the full-cut unit to produce the print label.

The print contents of the print label are acquired in a print contents acquisition process performed by the controller. Specification of cut pattern of the half-cut unit or the full-cut unit is acquired in a cut pattern acquisition process. In a coordination control process, the feeder, the printing head, the half-cut unit, and the full-cut unit are controlled to form the acquired print contents, and to realize the specified cut pattern, thus producing the print label.

According to the present disclosure, the display device displays an appearance image of the print label based on the control in the display control process, triggered by an appropriate operation before the print label production as described above. At this time, the displayed appearance image includes the identification display of the full-cut position formed by the full-cut unit and the half-cut position formed by the half-cut unit in addition to the print contents (such as texts and visual objects) to be printed. This allows the user to intuitively and simply recognize visually with what pattern and length the print label is cut and produced. As the result, if the print label is produced in accordance with the pattern not intended by the user, the user is allowed to restart various setting (re-adjustment of print contents and reset of the cut pattern), resulting in improved convenience.

The above-described convenience is especially effective for the structure with the function which provides the margin at the terminal end of the tape with print having the half-cut position at the boundary so as to avoid deteriorated convenience caused by the excessively short print label when the amount of print contents is small (for example, small number of text characters). In such a case, the print label actually produced in the coordination control process contains the half-cut position at the starting end portion of the margin, which is longer than the one intended by the user even if the cut pattern set by the user is only formation of the full-cut position (without formation of the half-cut position).

Accordingly, if the user does not desire to produce the long print label as described above, it is possible to avoid generation of the margin by formation of the half-cut position through re-adjustment of the print contents and reset of the cut pattern as described above. This makes it possible to improve convenience.

DETAILED DESCRIPTION OF THE PREFERRED EMBODIMENTS

Figure 1:
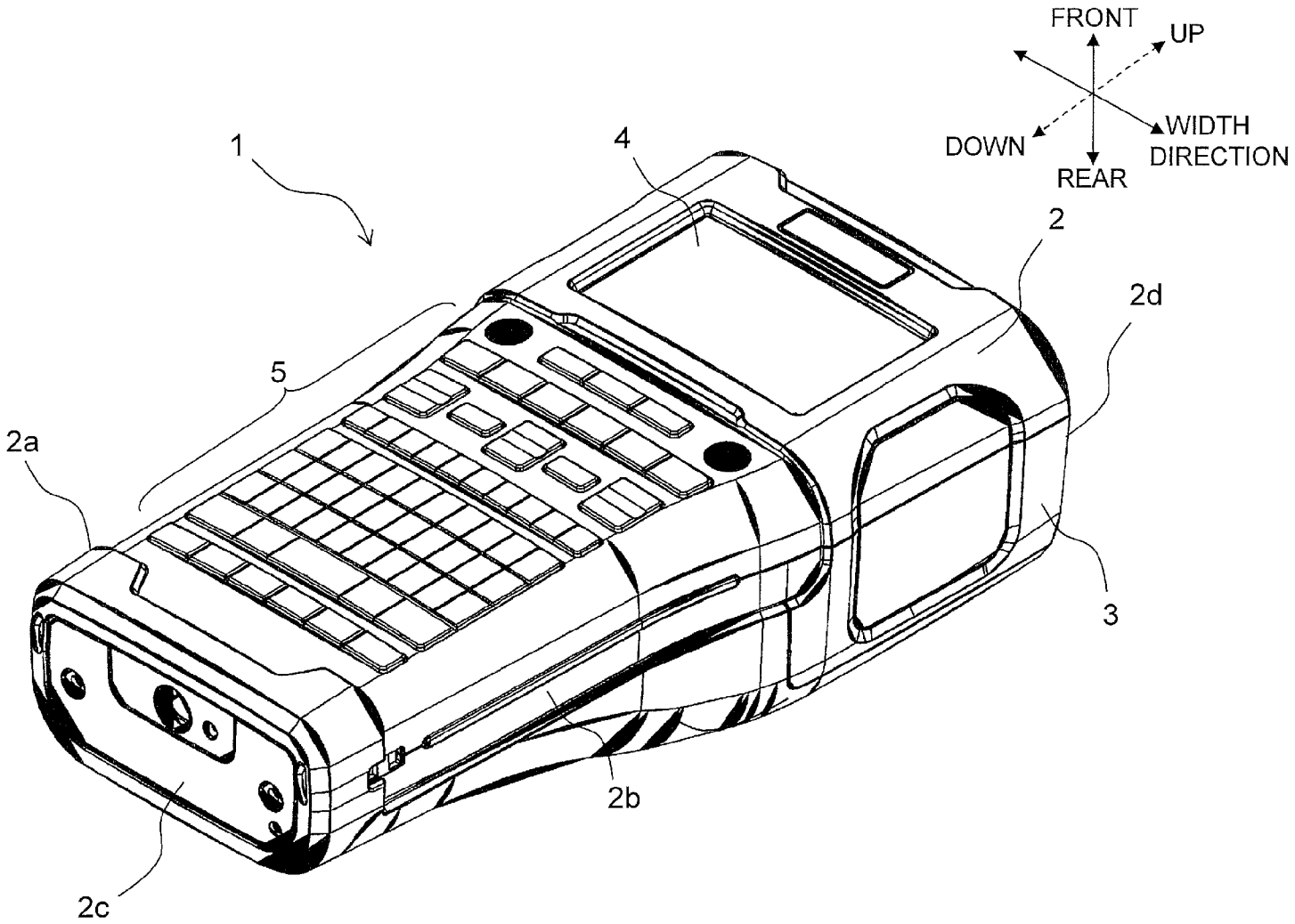
FIG. 1 is a perspective view mainly illustrating an appearance of a front side of a label producing apparatus according to a first embodiment of the present disclosure.

A first embodiment of the present disclosure will be described referring to the drawings. In the following explanations, terms used for explaining a print label producing apparatus 1 such as "upside", "downside", "front", "rear", "width" correspond to arrowed directions shown in FIG. 1 and other drawings, respectively. The term "thickness" used for explaining the print label producing apparatus 1 denotes the thickness in the vertical direction.

<Overall Structure of Label Producing Apparatus>

Figure 2:
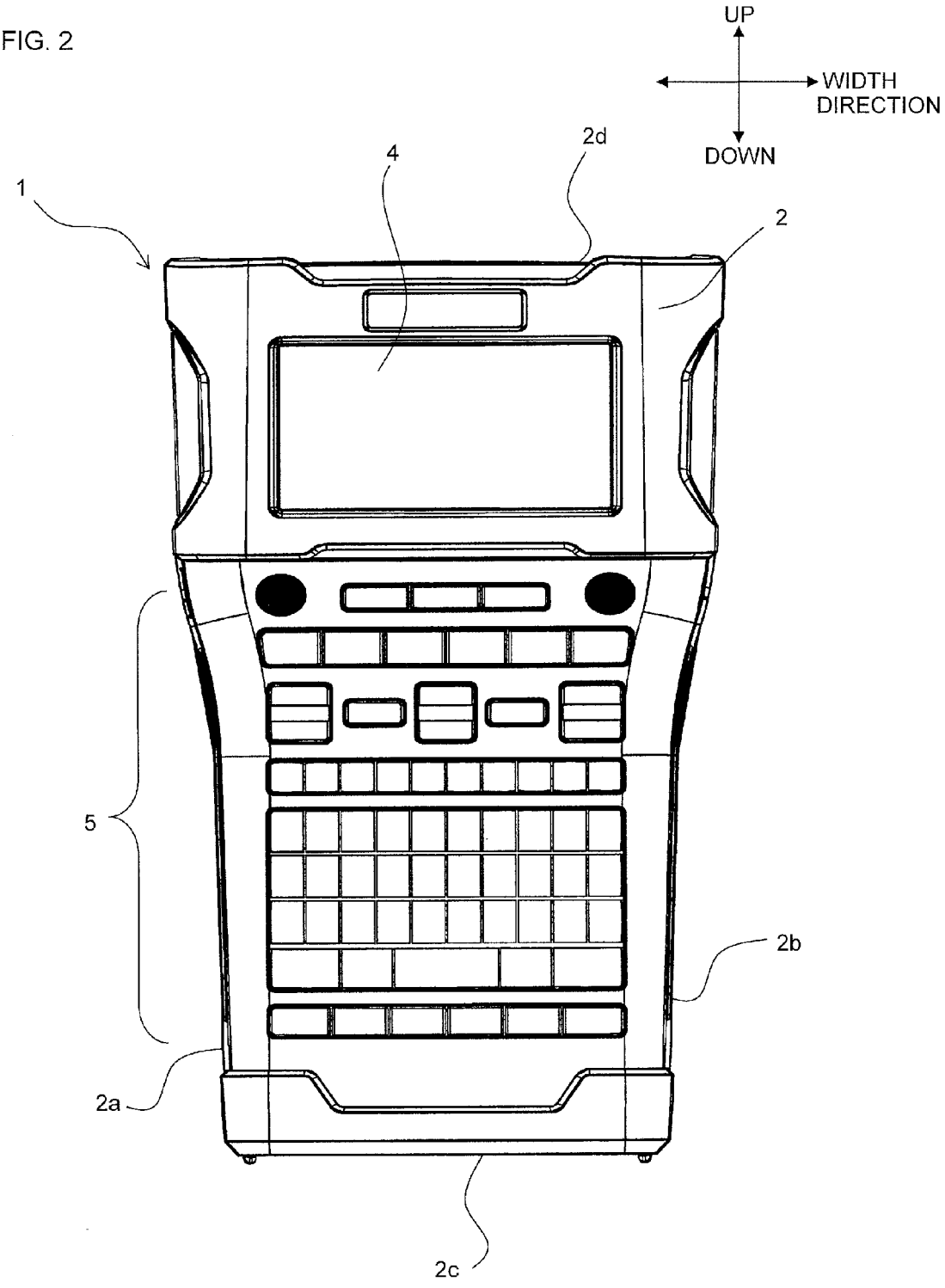
FIG. 2 is a plan view illustrating the appearance of the front side of the label producing apparatus according to the first embodiment of the present disclosure.
Figure 3:
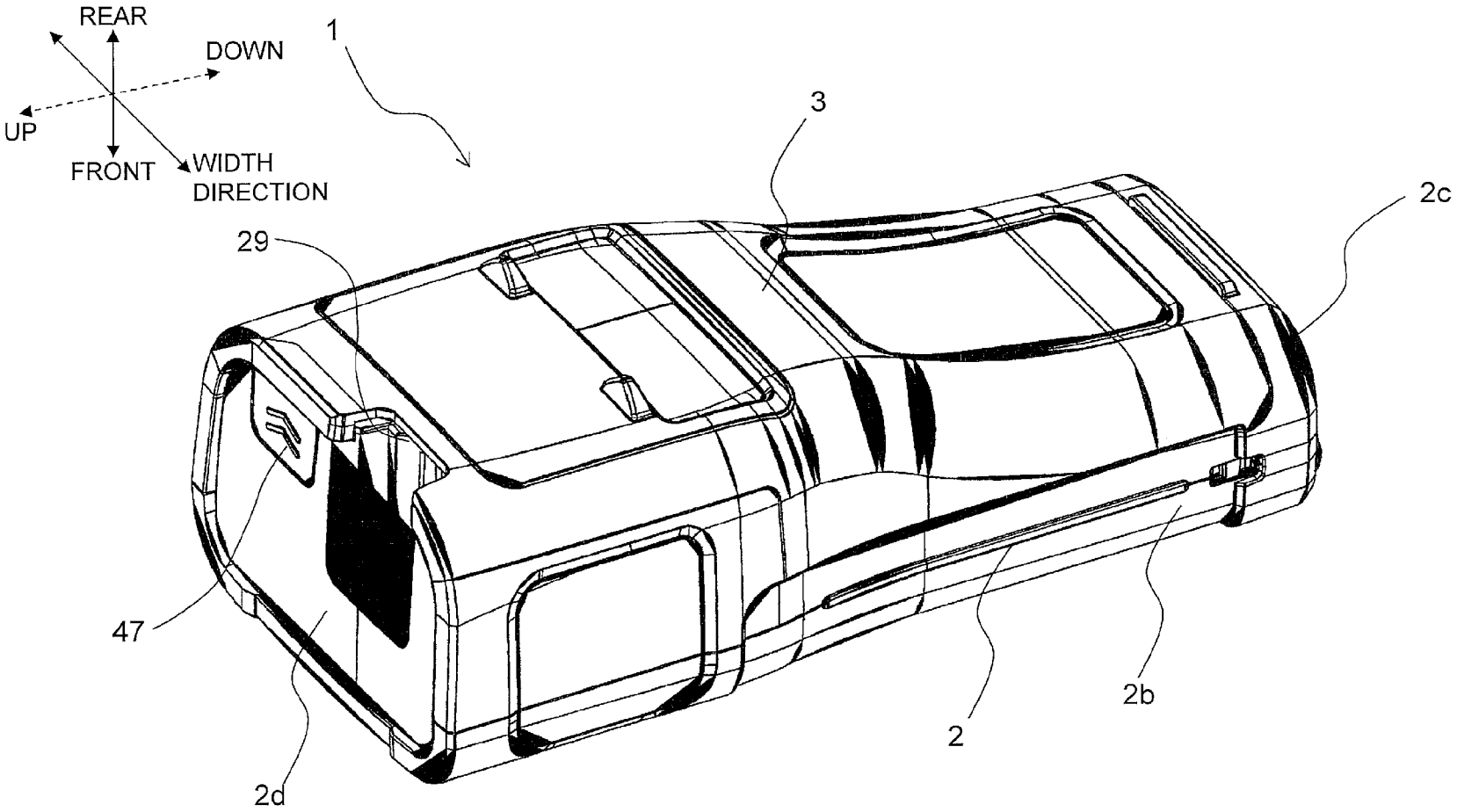
FIG. 3 is a perspective view illustrating an appearance of a rear side of the label producing apparatus according to the first embodiment of the present disclosure.

Referring to FIGS. 1 to 3, the print label producing apparatus 1 is a handheld type electronic apparatus gripped by the user's hand. The print label producing apparatus 1 includes an apparatus main body 2 that constitutes an apparatus outer housing, and a cover 3 detachably attached to a rear surface of the apparatus main body 2, which is allowed to open and close a cartridge holder 12 to be described later.

The apparatus main body 2 has a thin flat substantially rectangular parallelepiped shape, which is long in the vertical direction. A liquid crystal display section 4 is provided on the front surface of the apparatus main body 2 for displaying the print data, setting screen and the like on its upper portion. A keyboard section 5 is provided below the liquid crystal display section 4 for operating the print label producing apparatus 1. The keyboard section 5 has a key group including character keys such as characters, codes and numerals, and various function keys. A label discharging exit 29 is formed at a top end of the apparatus main body 2. A full-cutter mechanism 66 and a half-cutter mechanism 65 for cutting a label tape with print 109 (to be described later) are provided on the inner side of the label discharging exit 29. Both the mechanisms 65 and 66 will be described later.

<Cover Structure>

The cover 3 mainly includes a bottom portion and side portions extending from both lateral sides of the bottom portion so as to form a substantially U-like shape as a side view from the vertical direction, the detailed explanation with illustration of which is omitted. A projecting piece 47 (see FIG. 3) is attached to the upper end of the bottom portion while extending (downward) in the thickness direction of the apparatus main body 2 from the substantially center part. On the lower end of the bottom portion of the cover 3, insertion pieces (not shown) are provided to two points, which will be inserted into engagement holes 2*c*1 (see FIG. 4 to be described later) formed at two points in a lower portion 2*c* of the apparatus main body 2 in the width direction upon attachment of the cover 3 to the rear surface of the apparatus main body 2.

<Label Producing Mechanism of Print Label Producing Apparatus>

Figure 4:
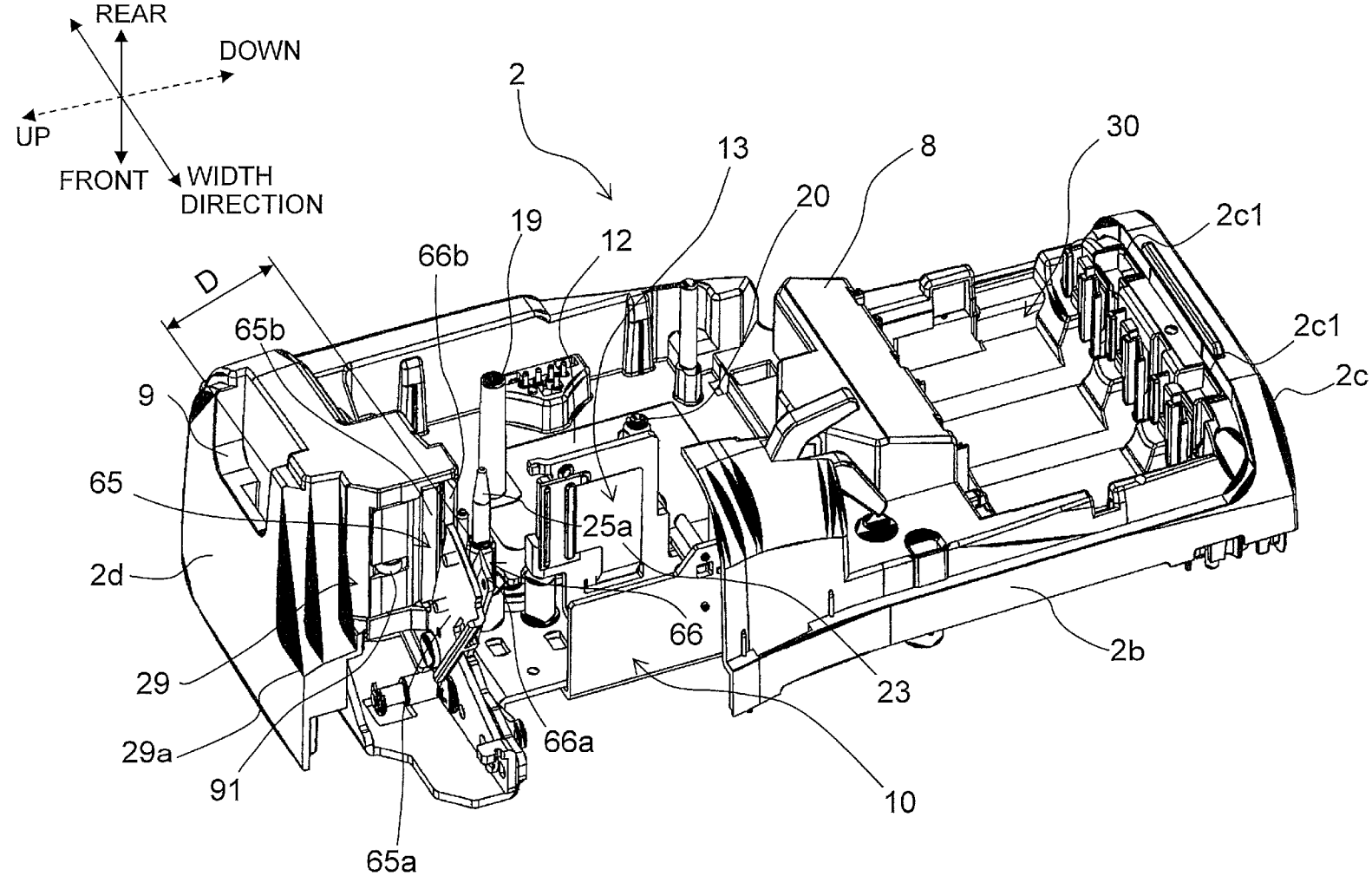
FIG. 4 is a perspective view illustrating an internal structure of an essential portion of the apparatus main body having no battery and cartridge loaded.
Figure 5:
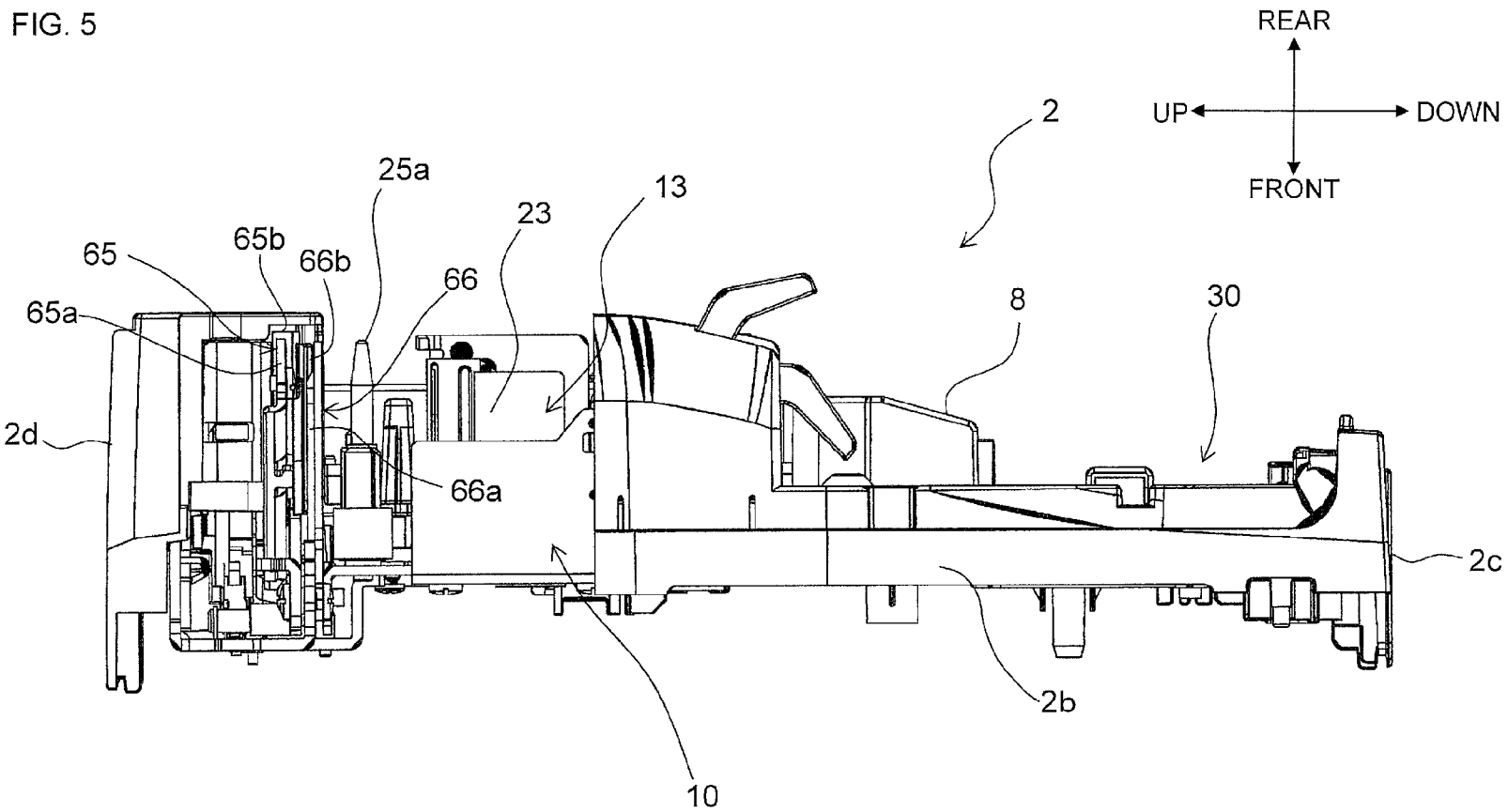
FIG. 5 is a side view illustrating the internal structure of the essential portion of the apparatus main body having no battery and cartridge loaded.

Referring to FIGS. 4 and 5, the apparatus main body 2 includes a label producing section 10 and a battery storage section 30. The label producing section 10 is separated from the battery storage section 30 by a storage section 8 for storing a not shown control substrate, a motor 63*a* (see FIG. 7 to be described later) and the like. As FIGS. 4 and 5 show, an engagement opening 9 is formed in the upper end of the apparatus main body 2. The side wall portions 2*a* and 2*b* of the apparatus main body 2 provided in the lateral direction have stepped portions (not shown) each having the shape corresponding to the end of the cover 3 at the open side.

The label producing section 10 includes a concave cartridge holder 12 for detachably loading a cartridge 100 (see FIG. 6 to be described later) which occupies most of substantially upper half part of the apparatus main body 2, a print-feed mechanism 13 provided on the region containing the other lateral side of the cartridge holder 12 (diagonally left lower side shown in FIG. 4, and left side shown in FIG. 5), a full-cutter mechanism 66, and a half-cutter mechanism 65.

Figure 6:
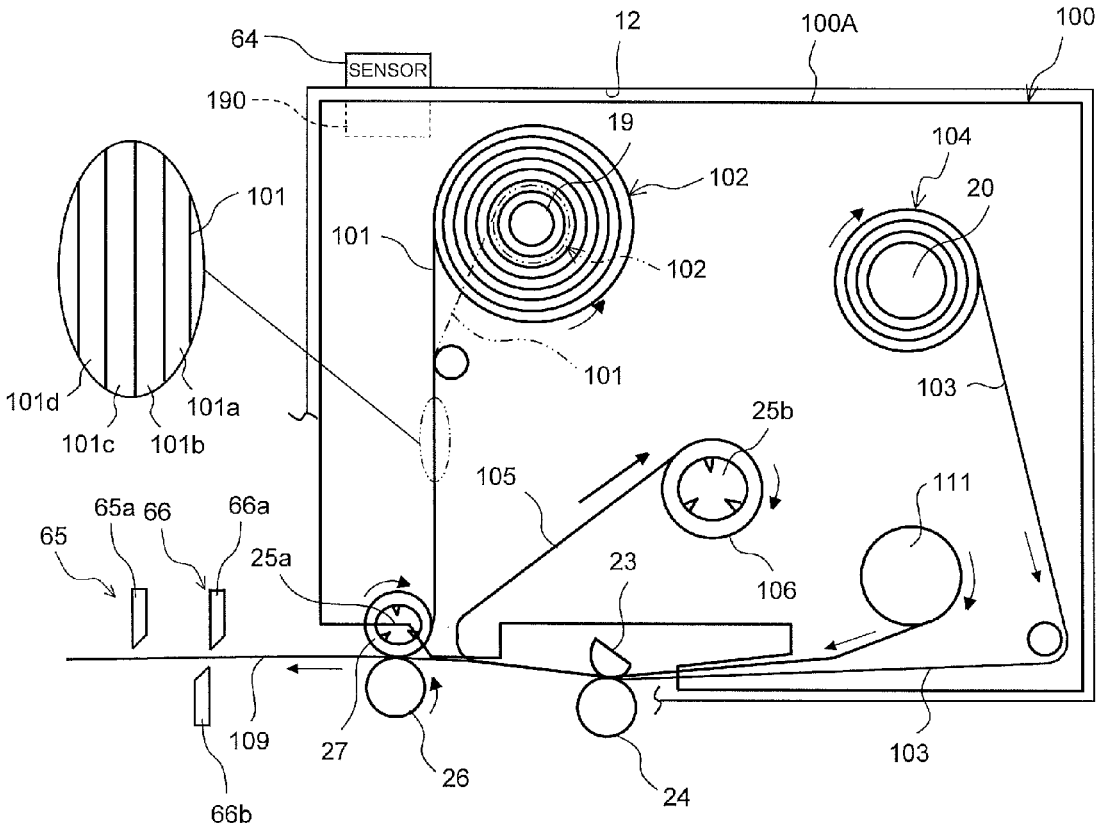
FIG. 6 is a schematic view showing a structure of the cartridge.

Referring to FIG. 6, the cartridge 100 has a known structure employed for the print label producing apparatus of this type. Specifically, the cartridge includes, inside a cartridge housing 100A, a base tape roll 102 which is wound to allow feeding of a base tape 101, a cover film roll 104 which is wound to allow feeding of a cover film 103 to be bonded to the base tape 101, an ink ribbon roll 111 which is wound to allow feeding of an ink ribbon 105, an ink ribbon take-up roller 106 which allows winding of the used ink ribbon 105, and a feeding roller 27.

In this example, the base tape 101 has a four-layer structure (see partially enlarged view of FIG. 6) formed by laminating from the inward wound side (right side shown in FIG. 6) to the other side (left side shown in FIG. 6) in the order of an adhesive layer 101*a* formed of a suitable adhesive, a colored base film 101*b* formed of PET (polyethylene terephthalate) and the like, an adhesive layer 101*c* formed of the suitable adhesive, and a separation material layer 101*d*. The adhesive layer 101*a* for bonding the cover film 103 in the process later is formed on the upper surface of the base film 101*b* (right side shown in FIG. 6), and the separation material layer 101*d* is bonded to the base film 101*b* on its rear side (left side shown in FIG. 6) via the adhesive layer 101*c*.

The cartridge 100 includes a detection target section 190 to be detected by a cartridge sensor 64 (see FIG. 6 and FIG. 7 to be described later) installed in the apparatus main body 2 upon loading of the cartridge 100 into the cartridge holder 12. The cartridge sensor 64 is configured to detect the detection target section appropriately formed in the cartridge 100 loaded into the cartridge holder 12 using the known method (for example, the method of mechanical contact type, the contactless type using magnetic or optical method). Based on the detection results of the cartridge sensor 64, a CPU 74 (see FIG. 7 to be described later) acquires type information of the cartridge 100 (including the width of the cover film 103 or the base tape 101, tape color information of the cover film 103, ink color information of the ink ribbon 105).

The print-feed mechanism 13 includes a support shaft 19 of the base tape roll 102, a support shaft 20 of the cover film roll 104, a support shaft (not shown) of the ink ribbon roll 111, a drive shaft 25*b* of the ink ribbon take-up roller 106 (see FIG. 6 and FIG. 7 to be described later), a thermal head 23, a platen roller 24 (see FIG. 6 and FIG. 7 to be described later), a drive shaft 25*a* for driving the feeding roller 27 upon loading of the cartridge 100 (see FIG. 6), a press roller 26 (see FIG. 7 to be described later), and the like. The platen roller 24 and the press roller 26 are attached to a not shown roll holder which swings to allow switching of the position between the print-feed position (not shown) in contact with the thermal head 23 and the feeding roller 27, respectively, and the stand-by position (not shown) apart from the thermal head 23 and the feeding roller 27.

In producing the print label, each position of the platen roller 24 and the press roller 26 is switched to the print-feed position. The platen roller 24 having its position switched to the print-feed position is driven to rotate by the motor 63*a* (see FIG. 7 to be described later) at the side of the apparatus main body 2 so as to press the cover film 103 fed from the cover film roll 104 and the ink ribbon 105 fed from the ink ribbon roll 111 against the thermal head 23. This allows the thermal head 23 to perform desired print in accordance with the print data on the cover film 103, and the platen roller 24 to feed the cover film 103 and the ink ribbon 105 which have finished printing to the feeding roller 27. The ink ribbon 105 having finished printing is thereafter separated from the cover film 103, and wound by the ink ribbon take-up roller 106 (see FIG. 6).

Meanwhile, the press roller 26 having its position switched to the print-feed position presses the cover film 103 which has finished printing and has been fed by the platen roller 24, and the base tape 101 fed from the base tape roll 102 to the feeding roller 27 which is rotated by the driving force of the drive shaft 25*a* linked to the motor 63*a* (see FIG. 7 to be described later). The cover film 103 and the base tape 101 which have finished printing are bonded together via the adhesive layer 101*a* to form the label tape with print 109. The feeding roller 27 feeds the label tape with print 109 to the label discharging exit 29 formed in the upper portion 2*d* of the apparatus main body 2. At a predetermined timing after discharge of the label tape with print 109 from the label discharging exit 29, a full-cutter movable blade 66*a* of the full-cutter mechanism 66, and a half-cutter movable blade 65*a* of the half-cutter mechanism 65 which are disposed near the front of the label discharging exit 29 along the feeding path are automatically activated in response to the command of the CPU 74 to be described later. As a result, the label tape with print 109 is cut to form the print label with desired length (see FIGS. 9A to 9D to be described later).

In this case, the label discharging exit 29 (specifically, an outlet 29*a* of the label discharging exit 29, see FIG. 4) is disposed apart from the full-cutter movable blade 66*a* of the full-cutter mechanism 66 along the tape feeding path by a relatively long distance D so that a finger of a child user is kept away from the full-cutter movable blade 66*a* for safety purpose (see FIG. 4). A feeding roller 91 is disposed in the area between the full-cutter movable blade 66*a* and the label discharging exit 29.

Referring to FIGS. 4 and 5, the full-cutter mechanism 66 includes the full-cutter movable blade 66*a* having one end axially supported to be swingable, a full-cutter fixed blade 66*b* fixed to face the edge of the full-cutter movable blade 66*a*, and a solenoid 66*d* (see FIG. 7 to be described later). The full-cutter movable blade 66*a* is swung by the driving force of the solenoid 66*d* excited in response to the control signal of the CPU 74 so as to be in abutment and rubbed against the full-cutter fixed blade 66*b* so as to fully cut the label tape with print 109 (that is, the base tape 101 and the cover film 103) in the thickness direction.

Referring to FIGS. 4 and 5, the half-cutter mechanism 65 includes the half-cutter movable blade 65*a* having one end axially supported to be swingable, a half-cutter receiving portion 65*b* fixed to face the edge of the half-cutter movable blade 65*a*, and a solenoid 65*d* (see FIG. 7 to be described later). The half-cutter movable blade 65*a* is swung by the driving force of the solenoid 65*d* excited in response to the control signal of the CPU 74, and in abutment against the half-cutter receiving portion 65*b* so as to be engaged therewith. As a result, the half-cut process is applied to the label tape with print 109. Specifically, the half-cutter movable blade 65*a* cuts only the separation material layer 101*d* of the base tape 101, which covers the adhesive layer 101*c* for bonding to an adhesion target, and keeps the remaining layer of the base tape 101 (adhesive layer 101*c*, base film 101*b*, adhesive layer 101*a*), and the cover film 103 uncut.

The battery storage section 30 is formed to have a long substantially rectangular shape with concave section in the lateral direction of the apparatus main body 2 in a planar view, which appropriately allows storage of the dry battery or the rechargeable battery.

<Control System of Label Producing Apparatus>

The control system of the print label producing apparatus 1 will be described referring to FIG. 7.

Figure 7:
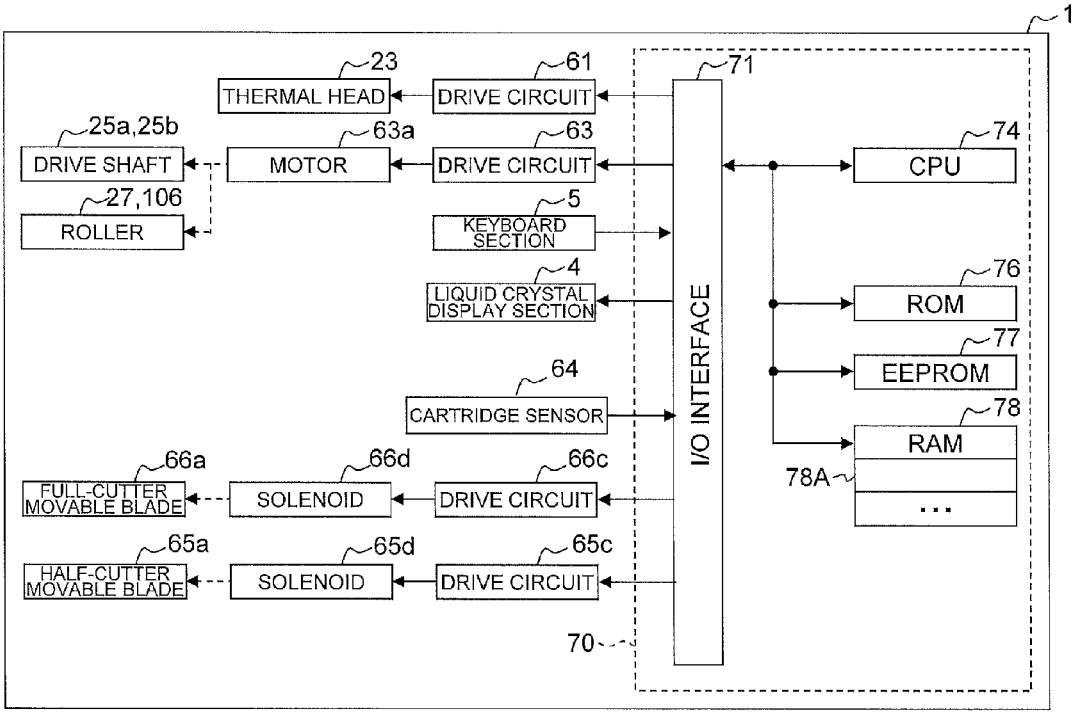
FIG. 7 is a functional block diagram showing a control system of the label producing apparatus.

Referring to FIG. 7, a control circuit 70 is disposed on the control substrate of the print label producing apparatus 1. The control circuit 70 includes the CPU 74 connected to a ROM 76, a RAM 78, an EEPROM 77, and an I/O interface 71 via a data bus. A non-volatile memory such as a flash memory may be employed instead of the EEPROM 77.

The ROM 76 stores various programs (for example, control programs for executing the respective procedures of the flow shown in FIGS. 11 to 15 to be described later) required for controlling the print label producing apparatus 1. The CPU 74 executes various arithmetic operations based on the respective programs stored in the ROM 76.

The RAM 78 temporarily stores results of the respective arithmetic operations executed by the CPU 74. The RAM 78 includes a label image memory 78A and the like.

The I/O interface 71 is connected to a thermal head driving circuit 61, a motor driving circuit 63, the keyboard section 5, the liquid crystal display section 4, the cartridge sensor 64, a full-cutter driving circuit 66*c*, a half-cutter driving circuit 65*c* and the like.

The thermal head driving circuit 61 controls current feed to a heater element (not shown) provided in the thermal head 23.

The motor driving circuit 63 controls driving of the motor 63*a* to drive the drive shafts 25*a*, 25*b* via a gear (not shown). This may rotate the feeding roller 27 and the ink ribbon take-up roller 106. The rotation of the gear at this time is transferred to the platen roller gear and the press roller gear (not shown). The platen roller 24 and the press roller 26 rotate along with rotations of the platen roller gear and the press roller gear.

The full-cutter driving circuit 66*c* controls current feed to the solenoid 66*d* to drive the full-cutter movable blade 66*a* of the full-cutter mechanism 66 for swing motions.

The half-cutter driving circuit 65*c* feeds current to the solenoid 65*d* to drive the half-cutter movable blade 65*a* of the half-cutter mechanism 65 for swing motions.

In response to the predetermined label producing instruction input by the user via the keyboard section 5, the control system including the control circuit 70 as a major component is configured to drive the platen roller 24 and the press roller 26 via the motor driving circuit 63 and the motor 63*a* so as to feed the cover film 103 and the like. In sync with this, a plurality of heater elements of the thermal head 23 is selectively driven for heat generation via the thermal head driving circuit 61 so that the print object is formed on the cover film 103 to be fed. The cover film 103 on which the print object is formed is bonded to the base tape 101 together by the press roller 26 to form the label tape with print 109. The label tape with print 109 is subjected to the full-cut process by the full-cutter mechanism 66 or half-cut process by the half-cutter mechanism 65 so as to produce the print label.

<Feature of the Embodiment>

Concerning the above-described structure, the embodiment is featured in that the full-cut position formed by the full-cutter movable blade 66*a* or the half-cut position formed by the half-cutter movable blade 65*a* may be displayed together with the appearance image of the print label on the liquid crystal display section 4 to produce the print label. The detailed process will be described in due succession.

<Transition of Display Contents on the Liquid Crystal Display Section>

Figure 8:
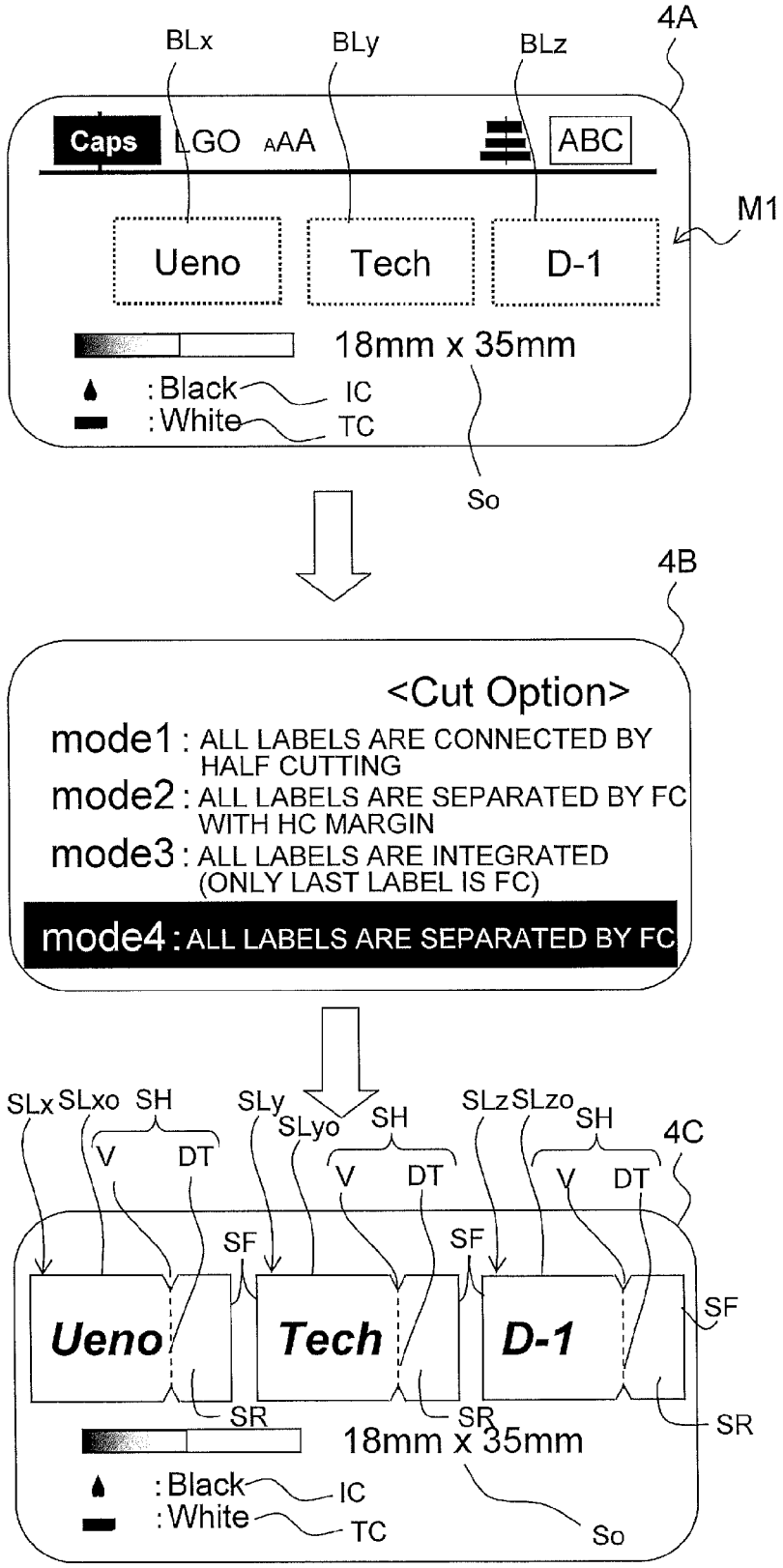
FIG. 8 is an explanatory view representing an example of a screen transition on the liquid crystal display section.

FIG. 8 shows an example of the display transition on the liquid crystal display section 4 when the user performs various operations for producing the print label.

<Edit Screen>

Referring to FIG. 8, the user first inputs the print objects to be arranged in the desired number of blocks (in this example, three blocks of BLx, BLy, BLz) via the keyboard section 5 in the state where the liquid crystal display section 4 displays an initial setting screen for edit (not shown). In this example, the character string "Ueno" is input to the first block BLx, the character string "Tech" is input to the next block BLy, and further the character string "D-1" is input to the next block BLz, respectively. In this stage, the liquid crystal display section 4 generates a setting image M1 concerning the print labels containing the character strings "Ueno" in the block BLx, "Tech" in the block BLy, and "D-1" in the block BLz, which are displayed as an edit screen 4A after the input operation.

Based on detection results of the cartridge sensor 64 upon loading of the cartridge 100 into the cartridge holder 12, the edit screen 4A also displays the dimension information So indicating that the width of the print label to be produced (in other words, width of the cover film 103 or the base tape 101) is 18 mm, and the length of the print label is 35 mm. Based on the above-described detection results, the edit screen 4A displays each text of the tape color information TC (in this example, white) and the ink color information IC (in this example, black) at the lower section of the edit screen 4A.

<Cut Option Screen>

The user appropriately inputs on the edit screen 4A via the keyboard section 5 so as to switch the screen to a cut option screen 4B displayed on the liquid crystal display section 4 as shown in FIG. 8. The cut option screen 4B assists the user to specify the desired mode for producing the print label with respect to the cut pattern formed by the full-cutter mechanism 66 and the half-cutter mechanism 65. Specifically, four modes are selectably displayed, including the mode 1 for producing a plurality of print labels all connected by the half-cut process, the mode 2 for producing a plurality of print labels all separated by the full-cut process (each having a margin with the half-cut position), the mode 3 for producing a plurality of print labels all integrated while having the last print label separated by the full-cut process only at the upstream-side terminal end, and the mode 4 for producing a plurality of print labels all separated by the full-cut process, respectively.

<Selection of Mode 1>

Figure 9A:
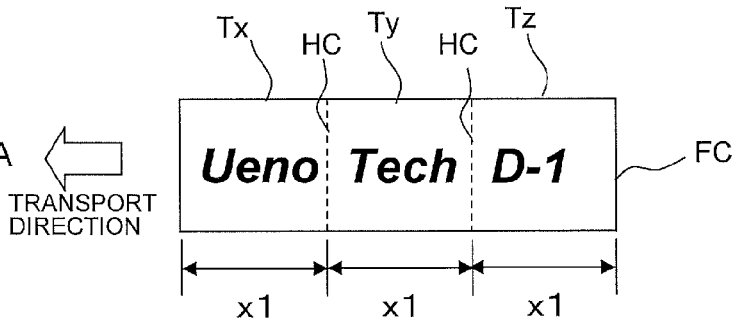
FIG. 9A is an explanatory view representing the print label produced in a mode selectable on the cut option screen.

FIG. 9A shows an example of the appearance of the print label to be produced in the mode 1 selected on the cut option screen 4B with respect to the setting contents on the edit screen 4A shown in FIG. 8. In this case, as shown in FIG. 9A, the three print labels, which are the print label Tx of the character string "Ueno", the print label Ty of the character string "Tech", and the print label Tz of the character string "D-1", are produced while being connected with each other via the half-cut position HC (indicated by broken line) (The terminal end of the print label Tz at the most upstream side along the transport direction is subjected to the full-cut position FC). Each of those three print labels Tx, Ty, Tz has the same length of x1 along the transport direction.

<Selection of Mode 2>

Figure 9B:
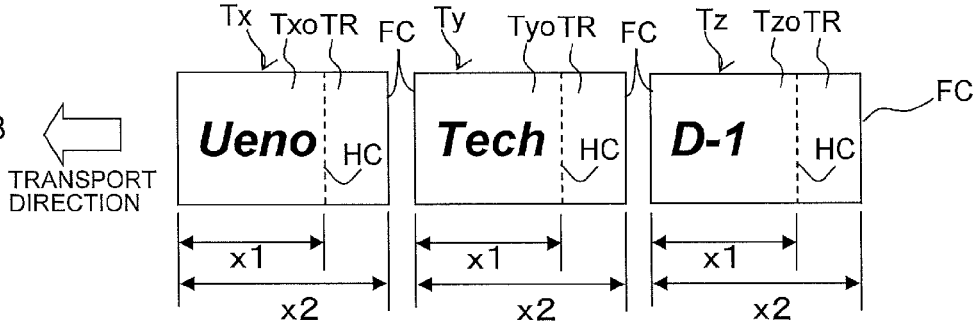
FIG. 9B is an explanatory view representing the print label produced in another mode selectable on the cut option screen.

FIG. 9B shows an example of the appearance of the print label to be produced in the mode 2 selected on the cut option screen 4B with respect to the setting contents on the edit screen 4A. In this case, as shown in FIG. 9B, the print label Tx of character string "Ueno", the print label Ty of character string "Tech", and the print label Tz of character string "D-1" are produced while being separated by the full-cut position FC. The print label Tx includes a label main body Txo on which a print is formed, and a margin TR formed at the upstream side of the label main body Txo in the transport direction with the half-cut position HC, on which no print is formed. Likewise, the print label Ty includes a label main body Tyo on which a print is formed, and a margin TR formed at the upstream side of the main body Tyo in the transport direction with the half-cut position HC, on which no print is formed. Furthermore, the print label Tz includes a label main body Tzo on which a print is formed, and a margin TR formed at the upstream side of the main body Tzo in the transport direction with the half-cut position HC, on which no print is formed.

Each of the label main bodies Txo, Tyo, and Tzo has the same length x1 along the transport direction. Each of the print labels Tx, Ty, and Tz has the same whole length (label length) of x2 derived from adding the length of the margin TR to the length x1.

<Selection of Mode 3>

Figure 9C:
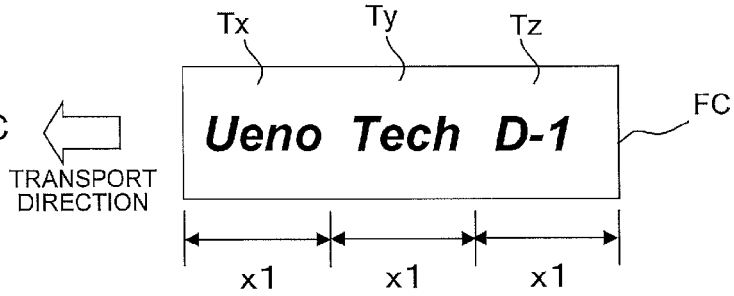
FIG. 9C is an explanatory view representing the print label produced in another mode selectable on the cut option screen.

FIG. 9C shows an example of the appearance of the print label to be produced in the mode 3 selected on the cut option screen 4B with respect to the setting contents on the edit screen 4A. In this case, as shown in FIG. 9C, the print label Tx of character string "Ueno", the print label Ty of character string "Tech", and the print label Tz of character string "D-1" are integrally produced. The terminal end of the print label Tz at the most upstream side in the transport direction becomes the full-cut position FC. Each of the print labels Tx, Ty, and Tz has the same length of x1 along the transport direction.

<Selection of Mode 4>

Figure 9D:
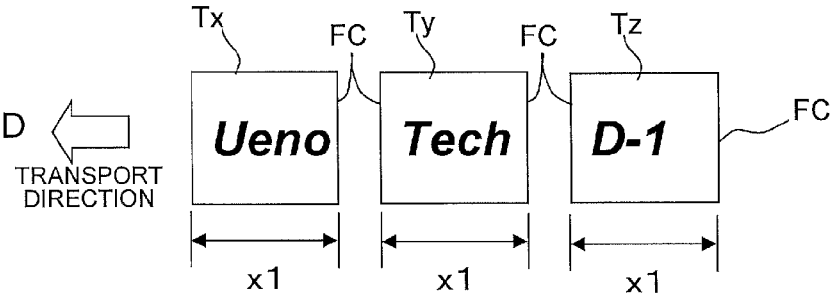
FIG. 9D is an explanatory view representing the print label produced in another mode selectable on the cut option screen.

FIG. 9D shows an example of the appearance of the print label to be produced in the mode 4 selected on the cut option screen 4B with respect to the setting contents on the edit screen 4A. In this case, as shown in FIG. 9D, the print label Tx of character string "Ueno", the print label Ty of character string "Tech", and the print label Tz of character string "D-1" are all separated by the full-cut position FC. Each of the print labels Tx, Ty and Tz has the same length x1 along the transport direction.

<Preview Screen>

Referring back to FIG. 8, the user performs appropriate input operations on the cut option screen 4B via the keyboard section 5 to select any one of the modes 1-4. Then the liquid crystal display section 4 switches the screen to display a preview screen 4C. FIG. 8 shows an example that the mode 4 is selected on the cut option screen 4B (the selected mode is reversely displayed in black).

<Automatic Mode Change>

The print label producing apparatus 1 according to the embodiment has the function for preventing deterioration in convenience caused by excessively short print label when the amount of print contents is small (small number of text characters). Specifically, as described above, in the embodiment, the label discharging exit 29 and the full-cutter movable blade 66*a* are located so that the distance D therebetween becomes relatively large. Therefore, in the case where the print labels on which the small number of characters such as "Ueno", "Tech", and "D-1" are printed are produced as they are in the mode 4, each length (in the example, x1) of the respective print labels Tx, Ty, Tz is smaller than the distance D as shown in FIG. 9D. As a result, if they are produced as they are, after cutting with the full-cutter movable blade 66*a*, the handelability in taking out the print labels Tx, Ty and Tz from the label discharging exit 29 may be deteriorated.

In the case where the print label to be produced has the length shorter than the distance D, the embodiment is configured to automatically correct the appropriate mode to the mode 2 (a plurality of print labels is all full-cut to be separately produced, each having the margin with the half-cut position) from the mode 4 (a plurality of print labels is all full-cut to be separately produced), even if the mode 4 has been selected on the cut option screen 4B as described above. In other words, the margin with the half-cut position is forcibly added to the upstream side of the print label (terminal end side) in the transport direction so that the length of the print label to be discharged is forcibly made longer than the distance D (see the length x2 shown in FIG. 9B).

As a result of the above described function, the actually produced print label becomes the one with the length longer than intended by the user through formation of the margin even if the mode 4 is selected by the user. In the case where the print label production instruction is issued through the appropriate operation of the user via the keyboard section 5, as shown in FIG. 9B, the print label Tx of "Ueno" having the label main body Txo and the margin TR connected with the half-cut position HC, the print label Ty of "Tech" having the label main body Tyo and the margin TR connected with the half-cut position HC, and the print label Tz of "D-1" having the label main body Tzo and the margin TR connected with the half-cut position HC are produced while being separated from one another.

In order to call user's attention to production of the print label having the cut pattern that is different from the intended one of the user, the embodiment is configured to allow preview of the appearance of the print label to be produced (in accordance with the above-described cut pattern). FIG. 8 shows an example of the preview screen 4C to be displayed when the above-described automatic switching of the mode from the mode 4 to the mode 2 was performed.

FIG. 8 shows the preview screen 4C displaying the appearance images of SLx of the print label "Ueno", SLy of the print label "Tech", and SLz of the print label "D-1" corresponding to the character strings "Ueno", "Tech", and "D-1" which are contained in the setting image M1 on the edit screen 4A. Referring to those appearance images SLx, SLy, and SLz, the screen displays identification data corresponding to the full-cut position FC and the half-cut position HC (full-cut position display SF and half-cut position display SH) of the respective print labels in addition to the print contents to be printed (character strings "Ueno", "Tech", "D-1"). In this example, the full-cut position display SF is represented by the solid line extending in the tape width direction in the respective displayed appearance images, and is shown apart from the other adjacent print labels so as to clearly identify the full-cut position FC formed by the full-cutter mechanism 66. The half-cut position display SH clearly identifies the half-cut position HC formed by the half-cutter mechanism 65 by the use of the broken line DT extending in the tape width direction on the displayed appearance image, and V-like grooves V, V formed at both end portions of the broken line DT.

In this case, as a result of switching the mode as described above, the displayed appearance image SLx of the print label "Ueno" contains the label main body SLxo of the appearance image as the print-forming section, and the margin appearance image SR corresponding to the margin TR connected to the upstream side in the transport direction (right side in the drawing) via the half-cut position display SH therebetween. Likewise, the displayed appearance image SLy of the print label "Tech" contains the label main body SLyo of the appearance image, and the margin appearance image SR corresponding to the margin TR connected to the upstream side in the transport direction via the half-cut position display SH therebetween. Likewise, the displayed appearance image SLz of the print label "D-1" contains the appearance image SLzo of the label main body, and the margin appearance image SR corresponding to the margin TR connected to the upstream side in the transport direction via the half-cut position display SH therebetween.

Similar to the edit screen 4B, the preview screen 4C also displays the dimension information So, the tape color information TC, the ink color information IC (or color information of print performed by the printing head 23) together.

FIG. 8 shows an example of the preview display corresponding to the mode 2. As a result of selecting any one of the modes 1, 3, and 4, the screen displays the appearance image including the full-cut position display SF and the half-cut position display SH (in addition to the print contents) in accordance with the cut pattern corresponding to the selected mode (also see FIG. 10 to be described later).

<Re-Selection of Mode by User>

Looking at the preview screen 4C displayed as described above, the user is capable of clearly recognizing automatic switching of the mode from the mode 4 to the mode 2 as described above. As a result, the user is allowed to determine whether the print label production is still executed in the switched mode 2, or the other mode is manually selected again (if production of the long print label with the margin in the mode 2 does not conform to the user's intention).

Figure 10:
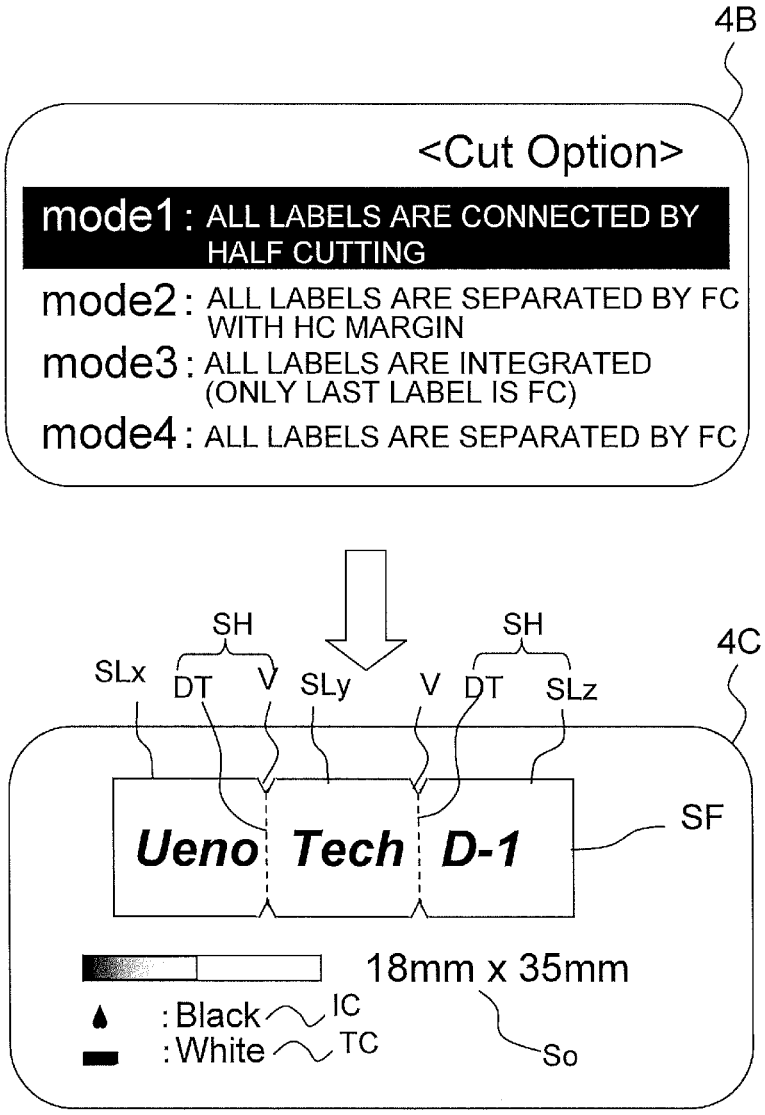
FIG. 10 is an explanatory view representing an example of the screen transition on the liquid crystal display section.

If another mode is selected again, the user appropriately inputs via the keyboard section 5 so that the liquid crystal display section 4 displays the cut option screen 4B again. The user is allowed to re-select any one of the modes 1-4. FIG. 10 shows the cut option screen 4B displaying the mode 1 selected by the user again (black reverse displayed part).

FIG. 10 shows an example of the preview screen 4C displayed in response to selection of the mode 1. Referring to FIG. 10, the preview screen 4C displays the appearance images SLx of the print label "Ueno", SLy of the print label "Tech", and SLz of the print label "D-1" similar to FIG. 8. Unlike FIG. 8, each of those appearance images SLx, SLy and SLz does not include the margin appearance image SR as described above. The screen shows the half-cut position display SH (including the broken line DT and the grooves V) corresponding to the half-cut position HC between the appearance image SLx of "Ueno" and the appearance image SLy of "Tech". The screen also shows the half-cut position display SH (including the broken line DT and the grooves V) corresponding to the half-cut position HC between the appearance image SLy of "Tech" and the appearance image SLz of "D-1" as well. The screen shows the full-cut position display SF corresponding to the full-cut position FC at the end of the downstream side (right side in the drawing) in the transport direction of the appearance image SLz of "D-1".

If the user is satisfied with the contents of the preview on the above-described preview screen 4C (because production of the long print label with the margin in accordance with the mode 2 can be avoided), the appropriate operation is performed via the keyboard section 5 to instruct the print label production. This makes it possible to produce three print labels, that is, Tx of character string "Ueno", Ty of character string "Tech" and Tz of character string "D-1" in accordance with the pattern shown in FIG. 9A while being connected to one another with the half-cut positions HC.

Alternatively, the user is allowed to select another mode from the modes 1-4 (for example, mode 3) on the cut option screen 4B displayed on the liquid crystal display section 4 through appropriate input operation via the keyboard section 5.

<Control Procedure>

The control procedure performed by the CPU 74 of the print label producing apparatus 1 for effectuating the above-described method will be described referring to the flowchart shown in FIG. 11.

Figure 11:
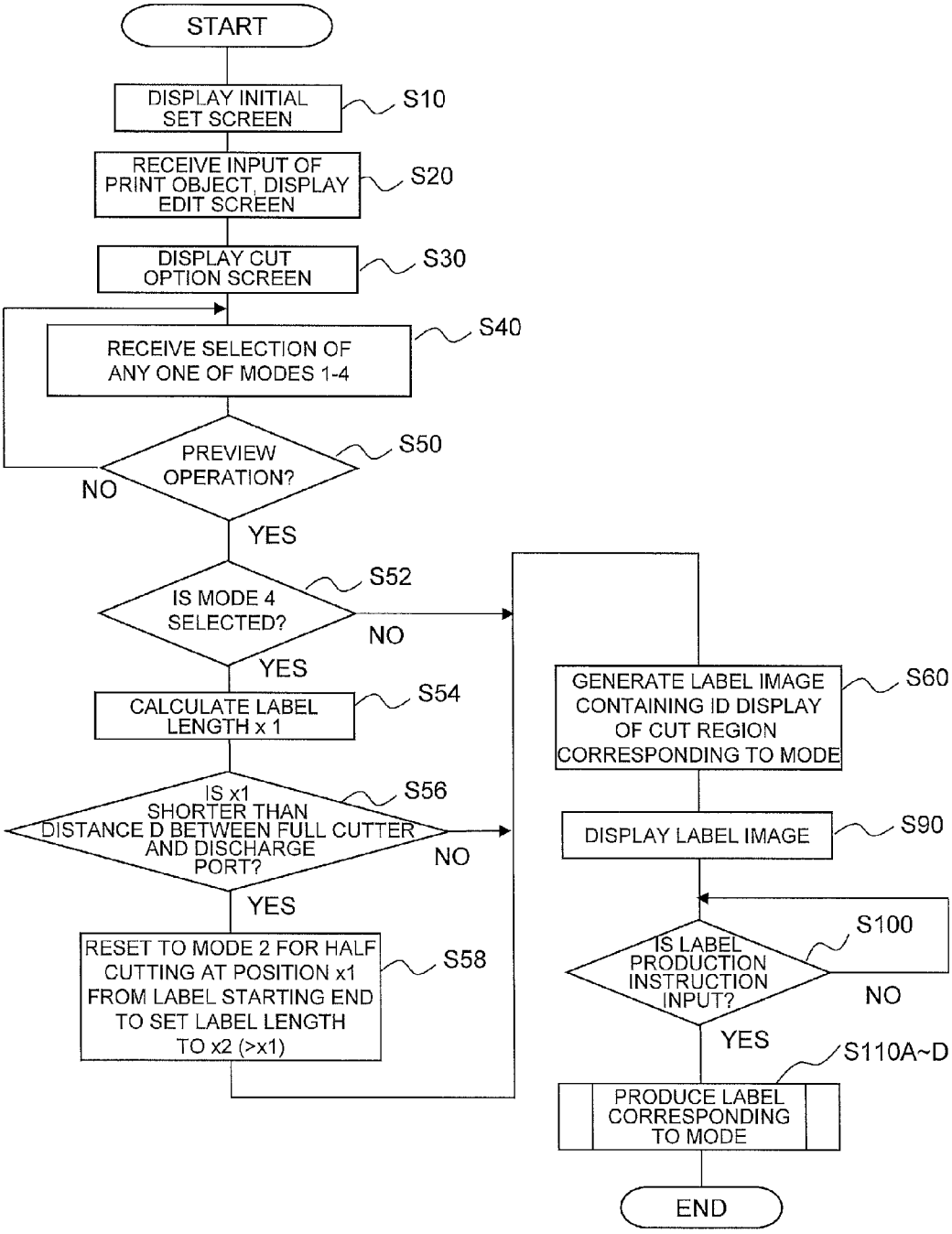
FIG. 11 is a flowchart representing the control procedure executed by the CPU.

Referring to FIG. 11, the process in this flow will be started, for example, by turning on the power source of the print label producing apparatus 1.

In step S10, the CPU 74 outputs the control signal to the liquid crystal display section 4 so as to display the initial setting screen for edit as described above. Thereafter, the process proceeds to step S20.

In step S20, the CPU 74 receives text input operations of the print objects such as character strings (character strings "Ueno", "Tech", "D-1" in the above-described example) which are provided in the desired number of blocks (three blocks BLx, BLy, BLz in the above-described example) via the keyboard section 5. The CPU 74 generates (displays) the single setting image M1 in which the respective blocks BLx, BLy, BLz each having the print object arranged in the tape length direction (see FIG. 8). The CPU 74 further outputs the control signal to the liquid crystal display section 4 so as to display the generated setting image M1 on the edit screen 4A (see FIG. 8).

Thereafter, the process proceeds to step S30 in response to the appropriate operation by the user via the keyboard section 5 so that the CPU 74 outputs the control signal to the liquid crystal display section 4 to display the cut option screen 4B. The cut option screen 4B displays the above-described four modes representing options of cut patterns (mode 1, mode 2, mode 3, mode 4) (see FIG. 8).

In step S40, the CPU 74 receives selection of any one of four modes displayed on the cut option screen 4B in response to the appropriate operation by the user via the keyboard section 5, for example.

Then the process proceeds to step S50 where the CPU 74 determines whether or not the preview operation has been performed by the user via the keyboard section 5. The determination in step S50 is not satisfied until the preview operation is performed (S50: NO). Then the process returns to step S40 where the similar steps are repeatedly executed. If the preview operation has been performed, the determination in step S50 is satisfied (S50: YES) so that the process proceeds to step S52.

In step S52, the CPU 74 determines whether or not the selected mode received in step S40 is the "mode 4". The determination in step S52 is not satisfied (S52: NO) until the "mode 4" is selected, and the process proceeds to step S60 to be described later. If the "mode 4" is selected, the determination in step S52 is satisfied (S52: YES), and the process proceeds to step S54.

In step S54, the CPU 74 calculates the length x1 (see FIG. 9D) along the transport direction of each of the print labels to be produced in accordance with the print contents acquired in step S20.

Thereafter, in step S56, the CPU 74 determines whether or not the length x1 calculated in step S54 is shorter than the above-described distance D (the distance from the full-cutter movable blade 66*a* of the full-cutter mechanism 66 along the tape feeding path to the label discharging exit 29). The determination in the step S56 is not satisfied (S56: NO) if the length x1 is equal to or longer than the distance D, and the process proceeds to step S60. If the length x1 is shorter than the distance D, the determination in step S56 is satisfied (S56: YES), and the process proceeds to step S58.

In step S58, the CPU 74 resets the mode from the selected mode 4 to the mode 2. The mode 2 is set so that the half-cut position HC is generated at a position with the length x1 (calculated in step S54) from the label starting end, and the whole length of the print label (label length) is set to x2

(>x1) obtained by adding the length of the margin TR (for example, the fixed value set preliminarily and appropriately) to the length x1.

Subsequently, in step S60, the CPU 74 generates the appearance images SLx, SLy, SLz corresponding to the setting image M1, which include the identification display of the full-cut position FC (full-cut position display SF) and the identification display of the half-cut position HC (half-cut position display SH) in accordance with the currently set mode (mode selected in step S40, or the mode 2 set in step S58). The identification display of the half-cut position HC may be expressed by displaying the text such as "half-cut", and "HC", and appropriate visual object other than the groove V without being limited to the aforementioned pattern. The process then proceeds to step S90.

In step S90, the CPU 74 outputs the control signal to the liquid crystal display section 4 so as to display the appearance images SLx, SLy, SLz generated in step S60 on the preview screen 4C (see FIGS. 8 and 10).

Then in step S100, the CPU 74 determines whether or not the predetermined label production instruction has been input by the user via the keyboard section 5. The determination in step S100 is not satisfied (S100: NO) until the label production instruction is input, and the process is brought into the loop standby state. Upon input of the label production instruction, the determination in step S100 is satisfied (S100: YES), and the process proceeds to any of the steps S110A, S110B, S110C and S110D.

In the steps S110A-S110D, the CPU 74 produces the print labels corresponding to the appearance images SLx, SLy, SLz, the preview of which are displayed in step S90. If the mode currently determined at this timing (or the mode to be executed) is the mode 1, the step S110A is executed (see FIG. 12 to be described later). In the case of the mode 2, the step S110B is executed (see FIG. 13 to be described later). In the case of the mode 3, the step S110C is executed (see FIG. 14 to be described later). In the case of the mode 4, the step S110D is executed (see FIG. 15 to be described later). Then the process terminates.

Although specific explanation will be omitted, regardless of the display phase, execution of the process steps subsequent to the subject phase in the flow shown in FIG. 11 may be terminated by pressing the escape key "Esc" on the keyboard section 5 so that the process flow terminates.

In this case, after receiving the edit contents on the edit screen 4A, the identification display of the half-cut position HC or the full-cut position FC is performed on the preview screen 4C. The aforementioned process is not limited to the one as described above. Specifically, it is possible to perform the identification display of the half-cut position HC or the full-cut position FC by returning the screen to the edit screen 4A in response to selection of the mode on the cut option edit screen 4C after receiving the edit contents on the edit screen 4A. It is sufficient that the identification display of the half-cut position HC or the full-cut position FC is performed at least before actually starting production of the print label in the steps S100A-S100D.

<Detail of Label Producing Process>

The detailed procedure for producing the labels in the steps S110A-S110D will be described referring to FIGS. 12 to 15.

<Process for Producing Label in Mode 1>

Figure 12:
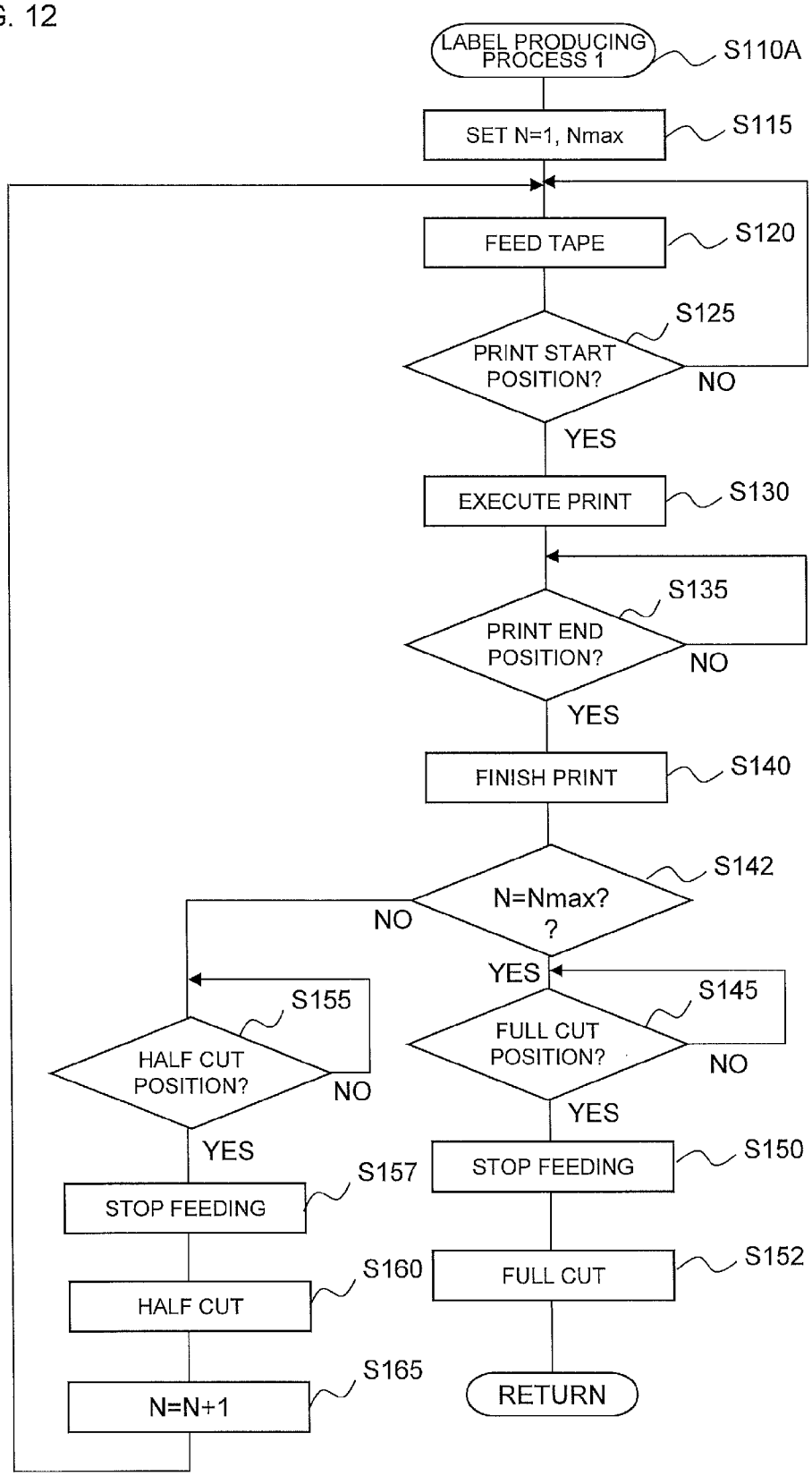
FIG. 12 is a flowchart representing the detailed procedure of the step S110A.

The label producing process in the step S110A corresponding to the "mode 1" will be first described referring to FIG. 12.

Referring to FIG. 12, first in step S115, the CPU 74 sets the value of a variable N related to the number of the print labels to be produced to one. In response to the appropriate operation (operation for inputting the number of the labels to be produced) by the user via the keyboard section 5, the CPU 74 further sets the maximum value Nmax of the variable N (Nmax=3 in the example shown in FIG. 9).

Subsequently, in step S120, the CPU 74 outputs the control signal to the motor driving circuit 63 to start driving the motor 63*a*. The gear is thereby driven to rotate so as to start rotating the platen roller 24 and the press roller 26, and thus feeding of the cover film 103, the base tape 101, and the label tape with print 109 (hereinafter referred to simply as "cover film 103 and the like".) is started.

Then, the process proceeds to step S125 where the CPU 74 determines whether or not the position of the cover film 103 and the like in the transport direction has arrived at the desired print start position on the tape (in other words, whether or not the tape has been fed until the thermal head 23 is brought into the state to face the print start position) using the known method. The determination in step S125 is not satisfied (S125: NO) until such position arrives at the print start position. The process returns to step S120 to execute the similar procedure repeatedly. If the position arrives at the print start position, the determination in step S125 is satisfied (S125: YES), and the process proceeds to step S130.

In step S130, the CPU 74 outputs the control signal (in the above-described example, print data corresponding to the appearance image SLx, SLy, or SLz) in accordance with the labels in order corresponding to the value of the variable N at this timing to the thermal head driving circuit 61. As a result, the thermal head 23 is driven in accordance with the subject print data so as to start forming the print object (in the above-described example, character strings "Ueno", "Tech", "D-1") corresponding to the print data on the cover film 103.

In step S135, the CPU 74 determines whether or not the position of the cover film 103 and the like in the transport direction has arrived at the desired print end position (in other words, whether or not the tape has been fed until the thermal head 23 is brought into the state to face the print end position) using the known method. The determination in step S135 is not satisfied (S135: NO) until the position arrives at the print end position, thus bringing the process into the loop standby state. If the position has arrived at the print end position, the determination in step S135 is satisfied (S135: YES), and the process proceeds to step S140.

In step S140, the CPU 74 outputs the control signal to the thermal head driving circuit 61 to stop driving the thermal head 23 so as to terminate forming of the print object.

Subsequently, in step S142, the CPU 74 determines whether or not the variable N has reached the maximum value Nmax. If the variable N has not reached the maximum value Nmax, the determination is not satisfied (S142: NO), and the process proceeds to step S155. If the variable N has reached the maximum value Nmax, the determination is satisfied (S142: YES), and the process then proceeds to step S145, which will be described later.

In step S155, the CPU 74 determines whether or not the position of the cover film 103 and the like in the transport direction has arrived at the half-cut position (or whether or not the tape has been fed until the half-cutter movable blade 65*a* of the half-cutter mechanism 65 is brought into the state to face the half-cut position HC) using the known method. The determination in step S155 is not satisfied (S155: NO) until the position arrives at the half-cut position, and then the process is brought into the loop standby state. If the position has arrived at the half-cut position, the determination in step S155 is satisfied (S155: YES), and the process proceeds to step S157.

In step S157, the CPU 74 outputs the control signal to the motor driving circuit 63 to stop driving the motor 63*a*. As a result, the platen roller 24 and the press roller 26 stop rotating so that feeding of the cover film 103, the base tape 101, and the label tape with print 109 stops.

In step S160, the CPU 74 outputs the control signal to the half-cutter driving circuit 65*c* to feed current to the solenoid 65*d* so as to drive the half-cutter movable blade 65*a*. The half-cut position HC is thereby formed in the label tape with print 109 (half-cut process is executed).

Subsequently, in step S165, the CPU 74 adds the value 1 to the value of the variable N, and returns to step S120 where the similar procedure is repeatedly executed.

Meanwhile, in step S145 to which the process proceeds when the determination in step S142 is satisfied, the CPU 74 determines whether or not the position of the cover film 103 and the like in the transport direction has arrived at the full cut position (in other words, whether or not the tape has been fed to allow the full-cutter movable blade 66*a* of the full-cutter mechanism 66 to be brought into the state to face the full-cut position FC) using the known method. The determination in step S145 is not satisfied (S145: NO) until the position arrives at the full-cut position. The process is then brought into the loop standby state. If the position has arrived at the full-cut position, the determination in step S145 is satisfied (S145: YES), and the process proceeds to step S150.

In step S150, the CPU 74 outputs the control signal to the motor driving circuit 63 to stop driving the motor 63*a*. Thereby, rotation of the platen roller 24 and the press roller 26 is stopped and feeding of the cover film 103, the base tape 101, and the label tape with print 109 stops.

In step S152, the CPU 74 outputs the control signal to the full-cutter driving circuit 66*c* to feed current to the solenoid 66*d*, thereby driving the full-cutter movable blade 66*a*. As a result, the full-cut position FC is formed in the label tape with print 109 (full-cut process is executed). Thereafter, the routine terminates.

All the print labels desired by the user are produced according to the pattern in which all the print labels are connected to one another by the half-cut process.

<Process for Producing Label in Mode 2>

The label producing process of step S110B corresponding to the "mode 2" will be described referring to FIG. 13.

Figure 13:
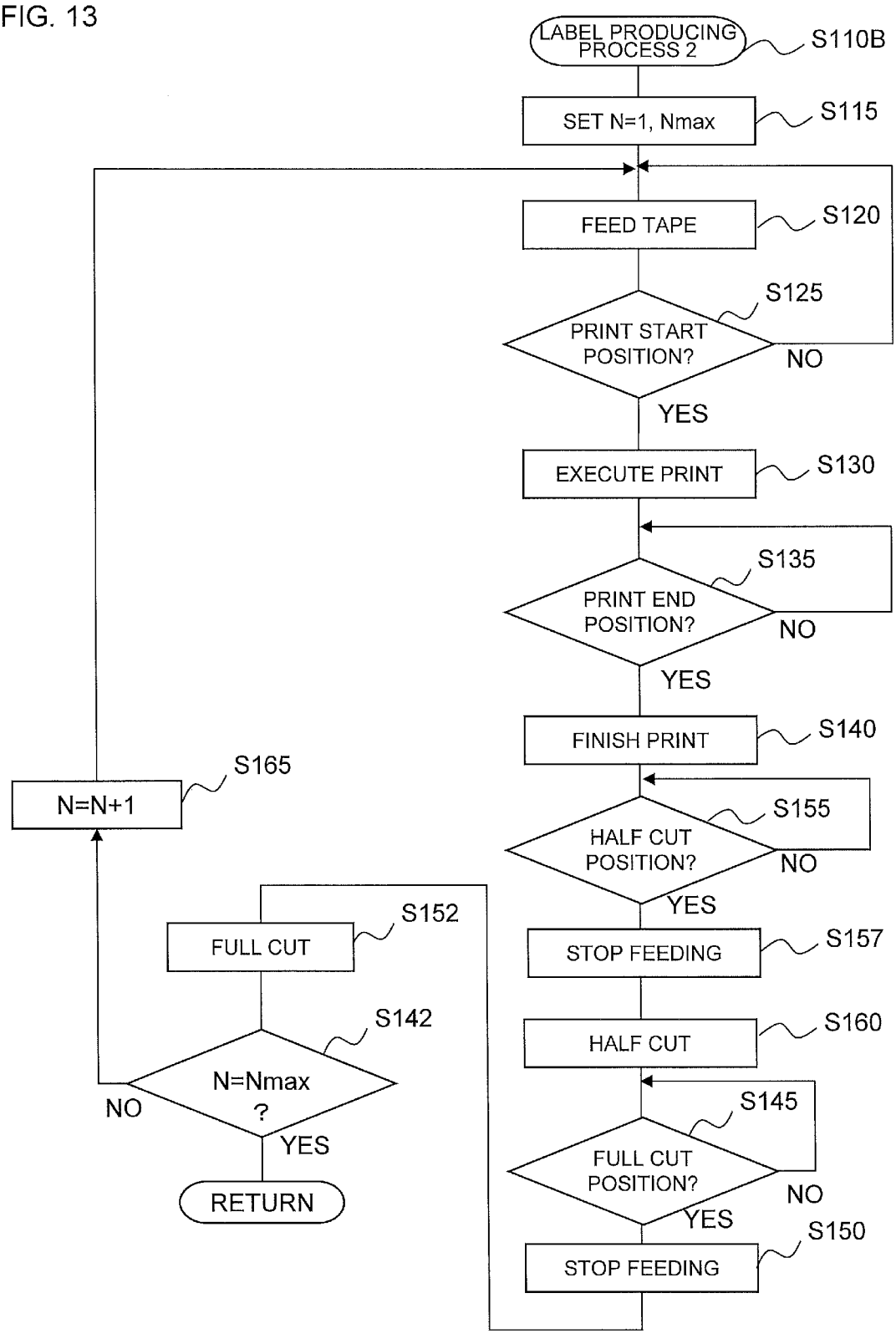
FIG. 13 is a flowchart representing the detailed procedure of the step S110B.

Referring to FIG. 13, in this flow, step S142 shown in FIG. 12 is omitted. The process steps S115-S140 are the same as those shown in FIG. 12, and detailed explanations thereof thus will be omitted.

Subsequent to step S140, steps S155, S157 and S160 similar to those shown in FIG. 12 are executed. As described above, if the position of the cover film 103 and the like in the transport direction arrives at the half-cut position, the half-cut position HC is formed.

Subsequent to the step S160, steps S145, S150 and S152 similar to those shown in FIG. 13 are executed. As described above, if the position of the cover film 103 and the like in the transport direction arrives at the full-cut position, the full-cut position FC is formed.

Thereafter, the process proceeds to step S142 similar to the one shown in FIG. 12 where the CPU 74 determines whether or not the variable N has reached the maximum value Nmax. If the variable N has not reached the maximum value Nmax, the determination is not satisfied (S142: NO). In step S165 similar to the one shown in FIG. 12, one is added to the variable N, and then the process returns to step S120 to execute the similar procedure repeatedly. If the variable N has reached the maximum value Nmax in step S142, the determination is satisfied (S142: YES), and the routine terminates.

Finally, the desired number of the print labels by the user may be produced in accordance with the pattern for separating the respective print labels by executing the full-cut process (each with margin via generated half-cut).

The label producing process of step S110C corresponding to the "mode 3" will be described referring to FIG. 14.

Figure 14:
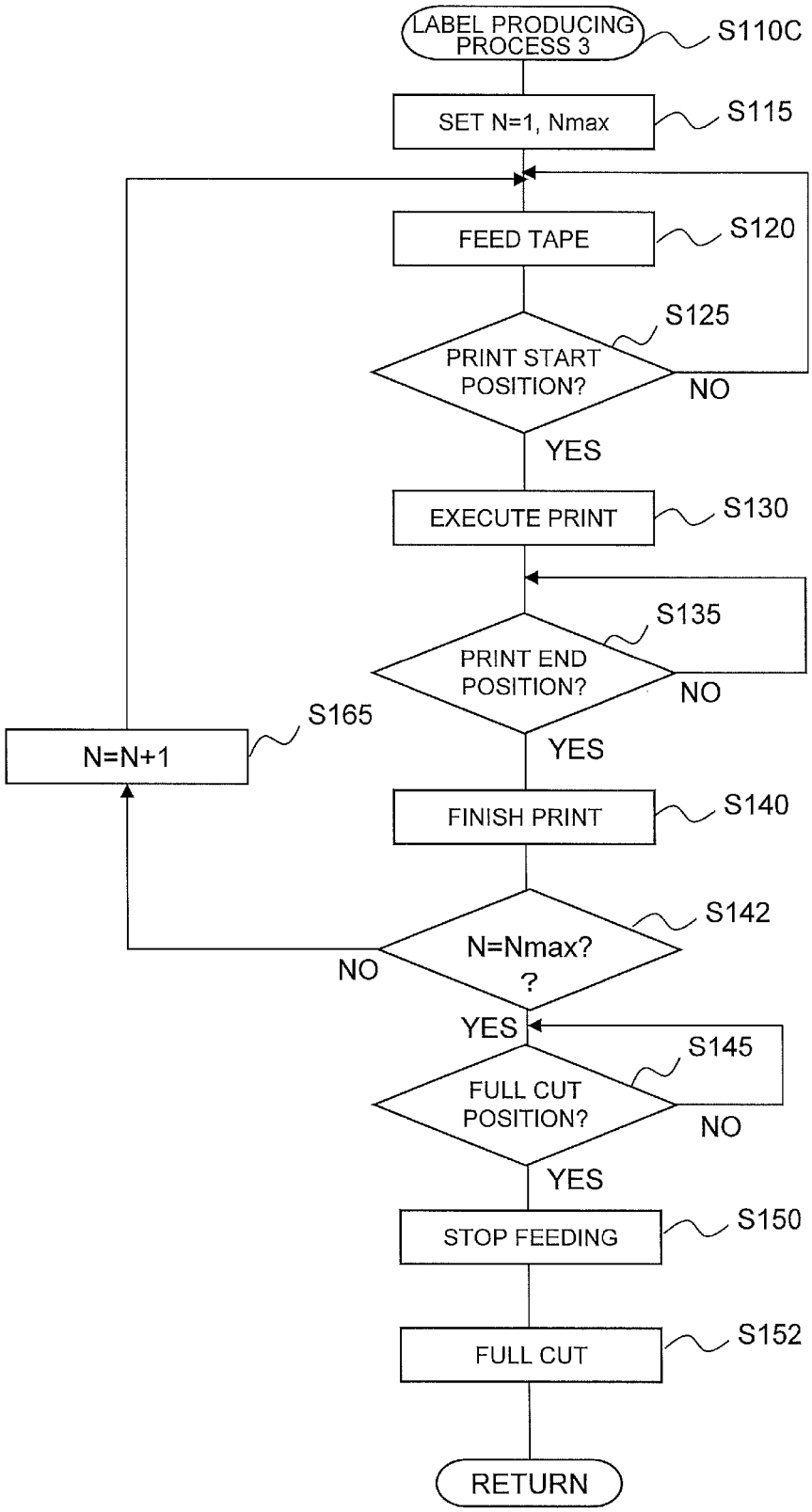
FIG. 14 is a flowchart representing the detailed procedure of the step S110C.

Referring to FIG. 14, the process from S115-S142 is the same as that shown in FIG. 12, and detailed explanations thereof thus will be omitted.

In step S142, the CPU 74 determines whether or not the variable N has reached the maximum value Nmax similarly to FIG. 12. If the variable N has not reached the maximum value Nmax, the determination is not satisfied (S142: NO). The process then proceeds to step S165 similar to the one shown in FIG. 12, where one is added to the value of the variable N. The process then returns to step S120 where the similar procedure is executed repeatedly.

If the variable N has reached the maximum value Nmax in step S142, the determination is satisfied (S142: YES), and the process proceeds to step S145 similarly to FIG. 12. Steps S150 and S152 subsequent to step S145 are similar to those shown in FIG. 12, and explanations thereof thus will be omitted.

Finally, the desired number of print labels desired by the user may be produced in accordance with the pattern for separating only the upstream end of the last produced print label by executing the full-cut process.

<Process for Producing Label in Mode 4>

The label producing process of step S110D corresponding to the "mode 4" will be described referring to FIG. 15.

Figure 15:
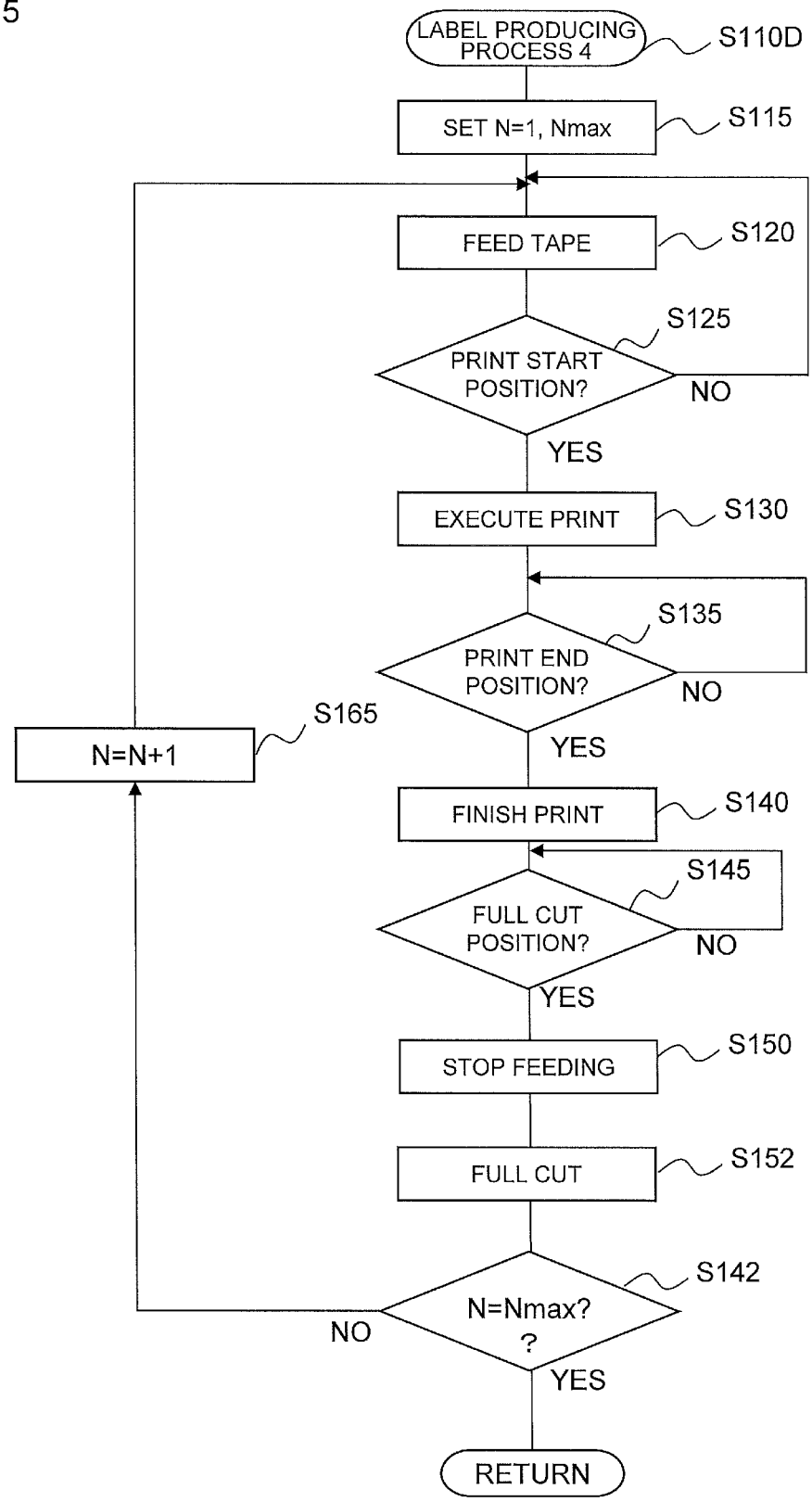
FIG. 15 is a flowchart representing the detailed procedure of the step S110D.

In the flow shown in FIG. 15, steps S155, S157 and S160 (concerning the process steps for executing the half-cut process) of the flow shown in FIG. 13 are eliminated. Otherwise, the flow is similar to the one shown in FIG. 13.

Specifically, in steps S115-S140 of FIG. 15 similar to those shown in FIG. 13, the print formation by the thermal head 23 is performed from the print start position to the print end position. Thereafter, the process returns to step S145.

In step S145 and subsequent steps S150 and S152, at the timing when the position of the cover film 103 and the like in the transport direction arrives at the full-cut position, the full-cut position FC is formed as described above.

Subsequently, in step S142 as described above, the CPU 74 determines whether or not the variable N has reached the maximum value Nmax. If the variable N has not reached the maximum value Nmax, the determination is not satisfied (S142: NO). Then the process proceeds to step S165 where one is added to the value of the variable N, and returns to step S120 where the similar procedure is executed repeatedly.

If the variable N has reached the maximum value Nmax in step S142, the determination is satisfied (S142: YES), and the routine terminates.

Finally, the number of print labels desired by the user may be produced in accordance with the pattern for separating all the respective print labels by executing the full-cut process.

<Advantageous Effect of Embodiment>

As has been described above, in the embodiment, the liquid crystal display section 4 displays the appearance images SLx, SLy, SLz of the print labels on the preview screen 4C, triggered by appropriate operations (preview operation in this example, see step S50 shown in FIG. 11)

before production of the print label. At this timing, the appearance images SLx, SLy, SLz display the print contents to be printed (such as texts and visual objects), together with identification displays corresponding to the full-cut position FC and the half-cut position HC (full-cut position display SF and the half-cut position display SH) for the respective print labels. The above-described display allows a user to intuitively and simply recognize visually with what pattern and length the print label is cut and produced (see FIGS. 8 and 10). As a result, as described referring to FIGS. 8 and 10, if the print label is produced in a pattern not conforming to the user's intention, the user is allowed to restart various settings (re-adjustment and reset of the cut pattern), thus improving convenience.

Particularly, as in the embodiment, if the print label becomes longer than intended by the user owing to the function of providing the margin TR when the amount of print contents is small, the user is allowed to re-adjust the print contents or reset the cut pattern to cancel generation of the margin SR by formation of the half-cut position HC, resulting in especially improved convenience (see FIG. 10).

In the embodiment, particularly, the length (length x1) of the print label to be formed along the transport direction is calculated. If the length is shorter than the predetermined length (above-described distance D), all the labels are separated each at the position with the length (x2) equal to or longer than the predetermined length D from the label starting end while having the half-cut position HC formed at the position with the length x1 from the label starting end. The resultant length of the print label is x2 (see FIG. 8). This makes it possible to avoid generation of deteriorated convenience and feeding failure caused by the excessively short print label. In the above-described case, the liquid crystal display section 4 displays the appearance images SLx, SLy, SLz of the print labels each with the length of x2, as well as the full-cut position display SF and the half-cut position display SH (see FIGS. 8 and 9B). This ensures that the user visually recognizes automatic generation of the margin as described above. The user who desires to avoid generation of such margin is allowed to re-adjust the print contents and reset the cut option without fail.

Although the user has set the cut pattern only for the full-cut process (that is, mode 4 is selected), the embodiment is particularly configured to automatically generate the margin SR by automatically forming the half-cut position HC in the case of the short print label to be produced. This ensures to avoid deteriorated convenience and feeding failure caused by the excessively short print label.

In the embodiment, it is determined whether or not the length x1 of the print label to be produced as described above is shorter than the distance D from the full-cutter movable blade 66*a* to the label discharging exit 29 (see step S56 of FIG. 11). The process ensures to avoid the feeding failure in the tape feeding path near the label discharging exit 29, which may be caused by the length of the print label being shorter than the distance D.

In the embodiment, the distance D between the full-cutter movable blade 66*a* and the label discharging exit 29 is set to be relatively large from the aspect of safety. This ensures to avoid the feeding failure caused by the length of the print label being shorter than the relatively long distance D.

The present disclosure is not limited to the above-described embodiment, but may be variously configured as long as it does not deviate from the scope and technical ideas.

As described above, the print label producing apparatus 1 of standalone type is configured to execute the process shown in FIG. 11 and FIGS. 12 to 15. However, the present disclosure is not limited to the configuration as described above. The print label producing apparatus 1 for producing the print label may be connected to the operation terminal by wireless or through a communication line. In this case, the edit screen 4A, the cut option screen 4B, and the preview screen 4C are displayed (including display of the label image in step S90) on the display screen of the operation terminal. In the steps S10-S50, and S100 of FIG. 11, the operation signals corresponding to the respective operations through the operation terminal are input to the print label producing apparatus 1 so as to execute the corresponding process. If the determination is satisfied in step S100, the print data for the label producing process corresponding to the mode are sent from the operation terminal to the print label producing apparatus 1 so that subsequent steps S110A-S110D are executed by the print label producing apparatus 1. This example also provides the similar advantageous effects to those of the above-described embodiment.

Arrows shown in FIG. 7 indicate exemplary signal flows, and are not intended to limit the signal flow direction.

The flowcharts shown in FIGS. 11 to 15 do not limit procedures that represent the present disclosure, but may have addition to, elimination from or any other modification with respect to the procedure in the order so as not to deviate from the scope or the technical ideas of the present disclosure.

It is also possible to make any other combinations of the processes of the embodiments other than those already described above.

The present disclosure may be put into practical use through various modifications in the range so long as it does not deviate from the scope of the present disclosure although the detailed descriptions are omitted.

What is claimed is:

1. A print label producing apparatus comprising:

a feeder configured to feed a print-receiving tape;

a printing head configured to form a print on said print-receiving tape fed by said feeder to produce a tape with print;

a half-cutter configured to form a half-cut position by partially cutting said tape with print in a thickness direction;

a cutter configured to form a full-cut position by fully cutting said tape with print in the thickness direction;

a display device configured to provide a desired display; and a controller, said print label producing apparatus being configured to produce a print label by said tape with print that has been fully cut by said cutter, said controller being configured to execute:

a print contents acquisition process for acquiring print contents to be formed on said print label;

a cut pattern acquisition process for acquiring specification of a cut pattern related to formation of said full-cut position and said half-cut position in producing said print label;

a coordination control process for forming the print contents acquired in said print contents acquisition process on said print-receiving tape, and forming said half-cut position or said full-cut position in accordance with the cut pattern acquired in said cut pattern acquisition process so as to produce said print label by controlling said feeder, said printing head, said half-cutter and said cutter in producing the label;

a display control process for controlling said display device triggered by an appropriate operation before said print label is produced by the control in said coordination control process to display an appearance image of said print label to be produced together with an identification display of all cut positions of said full-cut position and said half-cut position formed in producing the print label;

a length calculation process for calculating a first length of the print label extending along a transport direction, on which said print contents acquired in said print contents acquisition process are formed; and a determination process of determining whether or not said first length calculated in said length calculation process is shorter than a predetermined length, wherein if it is determined in said determination process that said first length is shorter than said predetermined length, in said coordination control process, said half-cut position is formed at a position with said first length from a label starting end, and said full-cutting is performed at a position with a second length equal to or larger than said predetermined length from the label starting end so as to produce a print label with the second length by controlling said feeder, said printing head, said half-cutter, and said cutter in producing the label; and in said display control process, said display device is controlled to, triggered by a predetermined operation before production start of the print label in said coordination control process, display an appearance image of said print label with said second length, the appearance image containing an identification display of said half-cut position at a position with said first length from the label starting end as well as an identification display of said full-cut position at a position with said second length from the label starting end.

2. The print label producing apparatus according to claim 1, further comprising:

a housing that contains said feeder, said printing head, said half-cutter and said cutter therein; and a discharging exit that is formed in said housing and is configured to discharge said tape with print outside the housing along a tape feeding path, wherein in said determination process, it is determined whether or not said first length is shorter than said predetermined length that is a distance from said cutter to said discharging exit along said tape feeding path.

3. The print label producing apparatus according to claim 2, wherein a mechanical operation mechanism is disposed in an area from said cutter to said discharging exit along said tape feeding path in said housing.

4. The print label producing apparatus according to claim 2, wherein in said display control process, said display device is controlled to display a solid line extending along a tape width direction so as to be separated from said appearance image of an adjacent print label, as the identification display of said full-cut position.

5. The print label producing apparatus according to claim 2, wherein in said display control process, said display device is controlled to display a broken line extending along a tape width direction and V-like grooves formed at both ends of the broken line, as the identification display of said half-cut position.

6. The print label producing apparatus according to claim 2, wherein in said display control process, said display device is controlled to display color information of said print-receiving tape together with color information of print formation by said printing head.

7. The print label producing apparatus according to claim 1, wherein in a case where specification of said cut pattern acquired in said cut pattern acquisition process includes formation of said full-cut position without formation of said half-cut position, if said first length is determined to be shorter than said predetermined length by said determination process, in said coordination control process said half-cut position is formed at a position with said first length from the label starting end, and also said full-cutting is performed at a position with the second length equal to or larger than said predetermined length from the label starting end, by controlling said feeder, said printing head, said half-cutter, and said cutter in producing the label.

8. The print label producing apparatus according to claim 1, wherein in said display control process, said display device is controlled to display a solid line extending along a tape width direction so as to be separated from said appearance image of an adjacent print label, as the identification display of said full-cut position.

9. The print label producing apparatus according to claim 1, wherein in said display control process, said display device is controlled to display a broken line extending along a tape width direction and V-like grooves formed at both ends of the broken line, as the identification display of said half-cut position.

10. The print label producing apparatus according to claim 1, wherein in said display control process, said display device is controlled to display color information of said print-receiving tape together with color information of print formation by said printing head.

* * * * *